US012077945B2

(12) United States Patent
Chiba et al.

(10) Patent No.: US 12,077,945 B2
(45) Date of Patent: Sep. 3, 2024

(54) OPERATION ASSISTANCE SYSTEM FOR WORK MACHINE HAVING AN EXTENDABLE WORK AREA

(71) Applicant: Hitachi Construction Machinery Co., Ltd., Tokyo (JP)

(72) Inventors: Takaaki Chiba, Tsuchiura (JP); Shinya Imura, Tsuchiura (JP); Shinjiro Yamamoto, Tsuchiura (JP); Masamichi Ito, Tsuchiura (JP); Koji Shiwaku, Tsuchiura (JP)

(73) Assignee: Hitachi Construction Machinery Co., Ltd, Tokyo (JP)

( * ) Notice: Subject to any disclaimer, the term of this patent is extended or adjusted under 35 U.S.C. 154(b) by 326 days.

(21) Appl. No.: 17/632,362

(22) PCT Filed: Mar. 25, 2020

(86) PCT No.: PCT/JP2020/013437
§ 371 (c)(1),
(2) Date: Feb. 2, 2022

(87) PCT Pub. No.: WO2021/192114
PCT Pub. Date: Sep. 3, 2021

(65) Prior Publication Data

US 2022/0282459 A1 Sep. 8, 2022

(51) Int. Cl.
*E02F 9/24* (2006.01)
*E02F 9/26* (2006.01)

(52) U.S. Cl.
CPC ..... *E02F 9/24* (2013.01); *E02F 9/262* (2013.01)

(58) Field of Classification Search
CPC ..... E02F 9/24; E02F 9/262
See application file for complete search history.

(56) References Cited

U.S. PATENT DOCUMENTS 5,198,800 A * 3/1993 Tozawa ..... E02F 9/2033 340/685
10,344,450 B2 7/2019 Sharp et al.
(Continued)

FOREIGN PATENT DOCUMENTS

JP 3-208923 A 9/1991
JP 4-52330 A 2/1992
(Continued)

OTHER PUBLICATIONS

Japanese-language Office Action issued in Japanese Application No. 2022-510234 dated Jan. 31, 2023 (five (5) pages).
(Continued)

*Primary Examiner* — Jess Whittington
(74) *Attorney, Agent, or Firm* — Crowell & Moring LLP

(57) ABSTRACT

An operation assistance system for a work machine includes an operation assistance function and a work assistance function. Both of the operation assistance function and the work assistance function are switchable between enabled and disabled states. When the work assistance function is in an enabled state and when the work area is set outside of the stop area to surround the stop area, the operation assistance system sets the work area as the stop area such that the stop area is extended and overlaid on the work area, and automatically enables the operation assistance function when the operation assistance function is in a disabled state.

4 Claims, 23 Drawing Sheets

(56) References Cited

U.S. PATENT DOCUMENTS

| | | | | |
|---|---|---|---|---|
| 2017/0191243 | A1* | 7/2017 | Sharp | E02F 5/06 |
| 2018/0347147 | A1* | 12/2018 | Doi | B60W 30/00 |
| 2020/0291614 | A1 | 9/2020 | Kiyota et al. | |
| 2022/0251803 | A1* | 8/2022 | Ushijima | E02F 9/262 |
| 2022/0364333 | A1* | 11/2022 | Ushijima | E02F 9/2033 |

FOREIGN PATENT DOCUMENTS

| | | | |
|---|---|---|---|
| JP | 9-71965 | A | 3/1997 |
| JP | 2006-257724 | A | 9/2006 |
| JP | 2015-9969 | A | 1/2015 |
| JP | 2019-157409 | A | 9/2019 |
| WO | WO 2019/111859 | A1 | 6/2019 |
| WO | WO 2019/181874 | A1 | 9/2019 |
| WO | WO 2019/189030 | A1 | 10/2019 |
| WO | WO 2019/189203 | A1 | 10/2019 |

OTHER PUBLICATIONS

International Search Report (PCT/ISA/210) issued in PCT Application No. PCT/JP2020/013437 dated Jun. 23, 2020 with English translation (six (6) pages).

Japanese-language Written Opinion (PCT/ISA/237) issued in PCT Application No. PCT/JP2020/013437 dated Jun. 23, 2020 (four (4) pages).

Extended European Search Report issued in European Application No. 20927448.9 dated Feb. 27, 2023 (eight (8) pages).

* cited by examiner

Fig. 7

| | Stop area | Deceleration area | Notification area | Others |
|---|---|---|---|---|
| Buzzer sound level | High | Medium | Low | None |

Work area setting screen

| | |
|---|---|
| Right side | 2m |
| Left side | 2m |
| Front side | 10m |
| Rear side | 2m |

Work area setting screen

| | |
|---|---|
| Upper side | 5m |
| Lower side | 2m |
| Front side | 10m |
| Rear side | 2m |

OPERATION ASSISTANCE SYSTEM FOR WORK MACHINE HAVING AN EXTENDABLE WORK AREA

TECHNICAL FIELD

The present invention relates to an operation assistance system for a work machine.

BACKGROUND ART

In a work machine with a work implement, such as a hydraulic excavator, an operation assistance function is known, which detects a worker or an obstacle around the work machine, notifies the result of detection to an operator, or decelerates and stops the operation of the work implement in order to prevent the work machine from coming into contact with the worker or the obstacle around the work machine (Patent Literature 1).

In the work machine, a work assistance function is also known, which controls the work implement so that the work implement does not go out of a work area set in advance, including a height, a depth, a turning angle, or the like (Patent Literature 2).

Using such a work assistance function can prevent the work implement from coming into contact with and destroying electric wires or underground objects and may improve work efficiency. In addition, when there is a limitation on the area in a turning direction, the work assistance function can prevent the work implement from running over a road during the work performed on the roadside of the road, for example.

CITATION LIST

Patent Literature

Patent Literature 1: JP 2006-257724 A
Patent Literature 2: JP H09-71965 A

SUMMARY OF INVENTION

Technical Problem

However, in the case of a work machine incorporating both operation assistance and work assistance functions described above, an area of the operation assistance function and an area (work area) of the work assistance function need be set individually, and an operator or the like may find such area setting inconvenient. In addition, when an area of the operation assistance function is set inside of a work area or the operator forgets to enable the operation assistance function, the operator may fail to recognize an object entering the work area, resulting in a collision of the work machine with the object.

The present invention provides an operation assistance system for a work machine having both operation assistance and work assistance functions, capable of reducing the inconvenience to an operator or the like of setting an area of the operation assistance function and an area of the work assistance function, and preventing a collision of the work machine with an object in a work area.

Solution to Problem

In view of the foregoing, the operation assistance system for a work machine of the present invention has the operation assistance function of stopping the work machine when an object is detected in a stop area set in advance based on detection information from a detection device that detects an object around the work machine with a work implement and the work assistance function of preventing the work machine from going out of a work area set in advance based on attitude information of the work machine. When the work area is set, the operation assistance system sets the work area as the stop area.

Advantageous Effects of Invention

According to the present invention, it is possible to reduce the inconvenience to an operator or the like of setting an area of the operation assistance function and an area of the work assistance function, and prevent a collision of the work machine with an object in a work area.

Other problems, configurations, and advantageous effects will become apparent from the following description of embodiments.

BRIEF DESCRIPTION OF DRAWINGS

FIG. 7 is a table showing a notification sound level of each area of the operation assistance function.

DESCRIPTION OF EMBODIMENTS

Hereinafter, embodiments of the present invention will be described with reference to the drawings. Parts having the same function are denoted by the same reference numbers throughout the drawings, and repeated description thereof may be omitted. It should be noted that the present embodiments describe the hydraulic excavator as one of the examples of the work machine. However, as long as the work machine can incorporate both operation assistance and work assistance functions, the present invention is not limited to the hydraulic excavator and can be applied generally to the work machines, such as wheel loaders, cranes, bulldozers, dumps, or road machines.

First Embodiment

Figure 1:
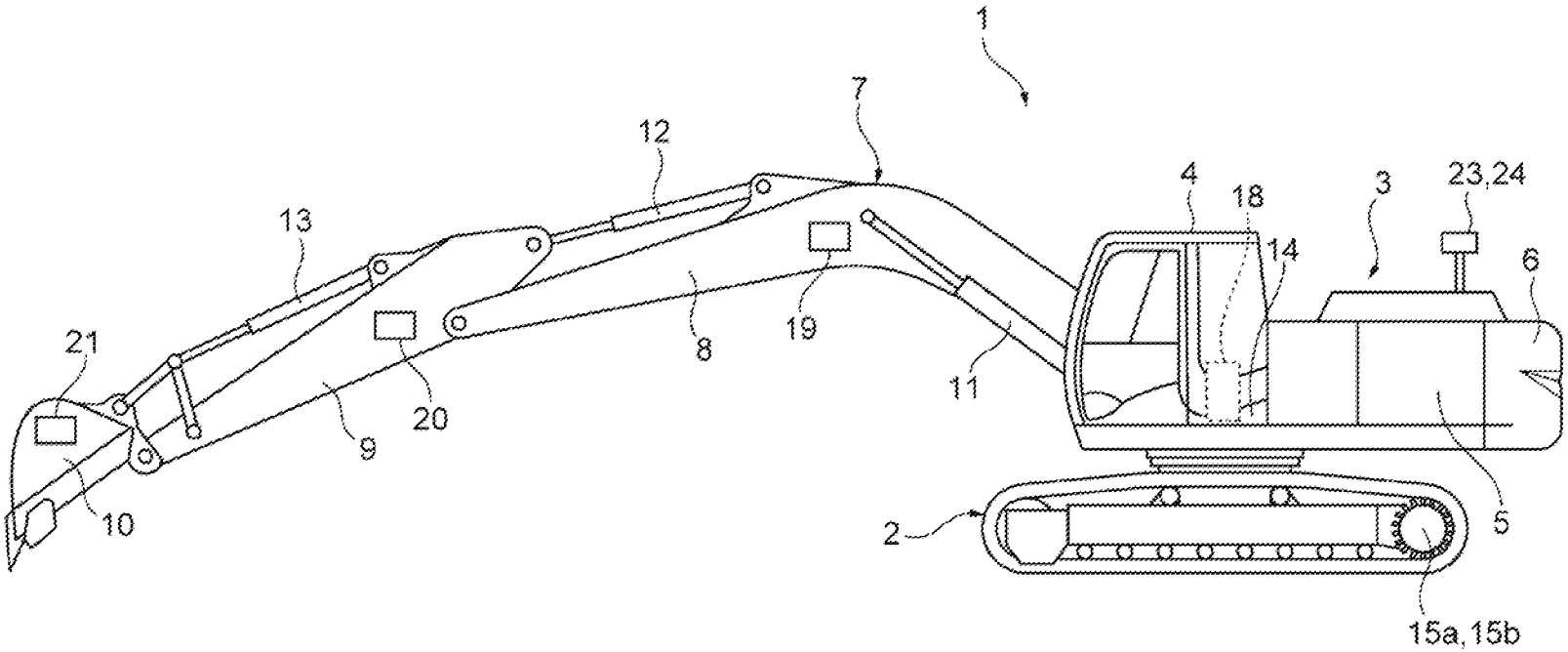
FIG. 1 is a side view of a hydraulic excavator according to a first embodiment.

FIG. 1 is a side view of a hydraulic excavator 1 as one of the examples of the work machine according to a first embodiment. The hydraulic excavator 1 includes a traveling body 2 that travels by driving crawlers provided on the right and left sides and a turning body 3 provided on the traveling body 2 to be able to turn.

The turning body 3 includes a cab 4, a machine room 5, and a counterweight 6. The cab 4 is provided on the left side of the front part of the turning body 3. The machine room 5 is provided on the rear side of the cab 4. The counterweight 6 is provided on the rear side of the machine room 5, that is, at the rear end of the turning body 3.

In addition, the turning body 3 is equipped with a work implement 7. The work implement 7 is provided on the right side of the cab 4, at the center of the front part of the turning body 3. The work implement 7 includes a boom 8, an arm 9, a bucket 10, a boom cylinder 11, an arm cylinder 12, and a bucket cylinder 13. The proximal end of the boom 8 is rotatably attached to the front part of the turning body 3 via a boom pin. The proximal end of the arm 9 is rotatably attached to the distal end of the boom 8 via an arm pin. The proximal end of the bucket 10 is rotatably attached to the distal end of the arm 9 via a bucket pin. Further, the boom cylinder 11, the arm cylinder 12, and the bucket cylinder 13 are hydraulic cylinders each driven by the hydraulic oil. The boom cylinder 11 drives the boom 8. The arm cylinder 12 drives the arm 9. The bucket cylinder 13 drives the bucket 10. This allows the hydraulic excavator 1 to perform digging operation, loading operation, and the like at construction sites.

A turning motor 14 is disposed at the center of the turning body 3. Driving the turning motor 14 allows the turning body 3 to rotate with respect to the traveling body 2.

In addition, a left traveling motor 15*a* and a right traveling motor 15*b* are disposed in the traveling body 2. Driving the left traveling motor 15*a* and the right traveling motor 15*b* allows the traveling body 2 to travel while driving the left and right crawlers.

Hereinafter, the boom cylinder 11 for boom driving, the arm cylinder 12 for arm driving, the bucket cylinder 13 for bucket driving, the turning motor 14 for turning operation, and the left traveling motor 15*a* and the right traveling motor 15*b* for traveling operation may be referred to as the actuator of the hydraulic excavator 1. In addition, the traveling body 2 and the turning body 3 may be collectively referred to as the body of the hydraulic excavator 1.

Figure 3:
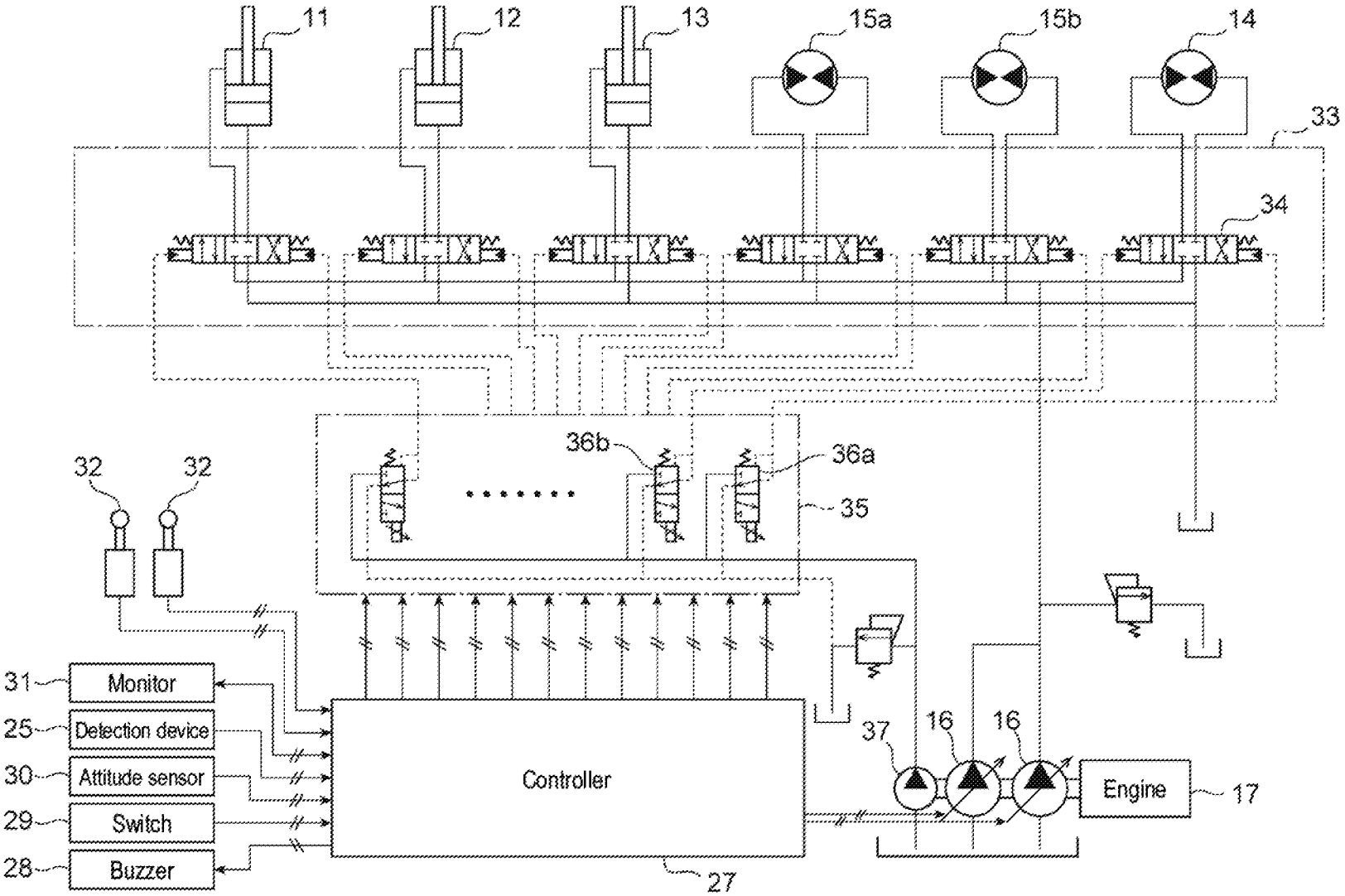
FIG. 3 is a system configuration diagram of the hydraulic excavator according to the first embodiment.

A hydraulic pump 16 and an engine (prime mover) 17 are disposed inside of the machine room 5 (see FIG. 3).

A body inclination sensor 18 is attached to the inside of the cab 4, a boom inclination sensor 19 is attached to the boom 8, an arm inclination sensor 20 is attached to the arm 9, and a bucket inclination sensor 21 is attached to the bucket 10. The body inclination sensor 18, the boom inclination sensor 19, the arm inclination sensor 20, and the bucket inclination sensor 21 are IMUs (Inertial Measurement Unit), for example. The body inclination sensor 18, the boom inclination sensor 19, the arm inclination sensor 20, and the bucket inclination sensor 21 measure a ground angle of the body, a ground angle of the boom 8, a ground angle of the arm 9, and a ground angle of the bucket 10, respectively. Further, a first GNSS antenna 23 and a second GNSS antenna 24 are attached to the rear part of the turning body 3 on the right and left sides. With signals obtained from the first GNSS antenna 23 and the second GNSS antenna 24, positional information of the body can be obtained.

Figure 2:
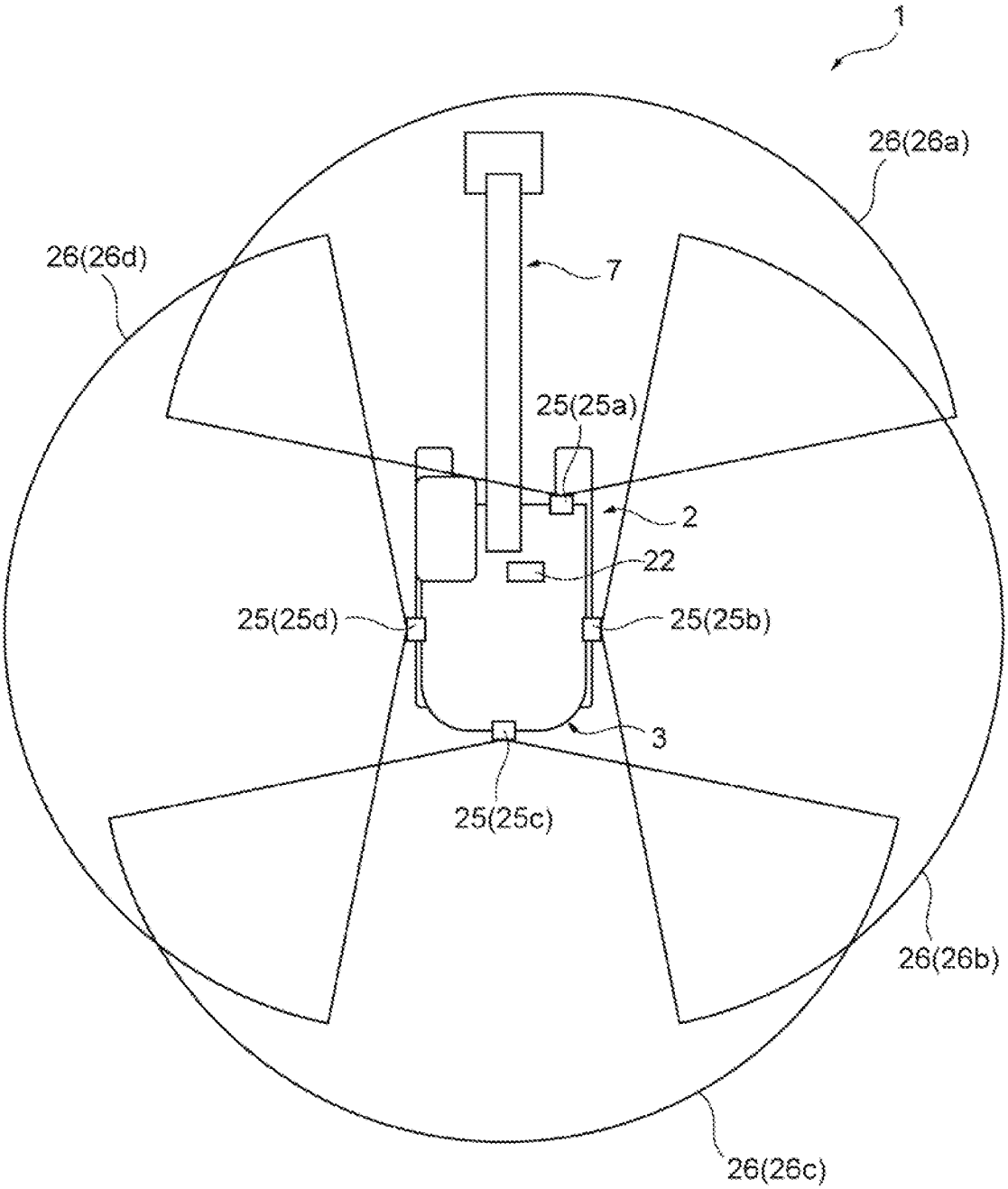
FIG. 2 is a top view of the hydraulic excavator according to the first embodiment.

FIG. 2 is a top view of the hydraulic excavator 1. A turning angle sensor 22 is attached to the turning body 3. With a signal of the turning angle sensor 22, a relative angle of the turning body 3 with respect to the traveling body 2 can be calculated. The turning angle sensor 22, the GNSS antennas (23, 24), and the inclination sensors (18, 19, 20, 21) form an attitude sensor 30 (FIG. 3) of the hydraulic excavator 1. With signals obtained from this attitude sensor 30 including the turning angle sensor 22 and the like, attitude information of the body can be obtained (this will be described later).

In addition, a detection device 25 is attached to the turning body 3. The detection device 25 detects an object (obstacle) around the hydraulic excavator 1. In this example, the detection device 25 includes four devices: a front side detection device 25*a* for detecting an obstacle on the front side, a right side detection device 25*b* for detecting an obstacle on the right side, a rear side detection device 25*c* for detecting an obstacle on the rear side, and a left side detection device 25*d* for detecting an obstacle on the left side. In addition, FIG. 2 shows a detection range 26 (26*a*, 26*b*, 26*c*, 26*d*) of the detection device 25 (25*a*, 25*b*, 25*c*, 25*d*).

The detection device 25 is a stereo camera, for example, and can calculate a distance from the hydraulic excavator 1 to an obstacle (an object to be detected). Further, the detection device 25 may be any device as long as it can measure a distance to the object to be detected, such as a millimeter wave radar or a laser radar, or a device using magnetic field, for example.

FIG. 3 is a system configuration diagram of the hydraulic excavator 1.

In the hydraulic excavator 1, the actuator (11, 12, 13, 14, 15*a*, 15*b*) is driven by being supplied with hydraulic oil ejected from the hydraulic pump 16 driven by the engine 17. The amount and direction of the oil supplied to the actuator can be controlled by driving a flow rate control valve in a flow rate control valve unit 33.

For example, a turning flow rate control valve 34 is a flow rate control valve for controlling the amount of oil supplied to the turning motor 14. When the turning flow rate control valve 34 moves to the left in the figure, oil is supplied so that the turning motor 14 rotates to the left. The rotation speed of the turning motor 14 can be controlled according to the movement amount of the turning flow rate control valve 34.

Meanwhile, when the turning flow rate control valve 34 moves to the right in the figure, oil is supplied so that the turning motor 14 rotates to the right.

The control of the turning flow rate control valve 34 is performed by controlling a solenoid proportional pressure reducing valve in a solenoid proportional pressure reducing valve unit 35. The solenoid proportional pressure reducing valve decompresses oil supplied from a pilot pump 37 and supplies the oil to the flow rate control valve according to an instruction from a controller 27.

For example, when a leftward turning solenoid proportional pressure reducing valve 36*a* is driven, the pressure oil is supplied so that the turning flow rate control valve 34 moves to the left in the figure. When a rightward turning solenoid proportional pressure reducing valve 36*b* is driven, the pressure oil is supplied so that the turning flow rate control valve 34 moves to the right in the figure.

Though not shown, the controller 27 is configured as a computer including a CPU (Central Processing Unit) that executes various operations, a storage unit such as a ROM (Read Only Memory), a HDD (Hard Disk Drive), or the like that stores programs for executing the operations by the CPU, a RAM (Random Access Memory) serving as a work area when the CPU executes the programs. The CPU loads various programs stored in the storage unit into the RAM and executes the programs so that the functions of the controller 27 are implemented.

The controller 27 calculates and outputs control signals to the solenoid proportional pressure reducing valve unit 35, the hydraulic pump 16, and a buzzer 28 based on a signal from a control lever 32, a signal from a monitor 31, a signal from the detection device 25 (detection information), a signal from the attitude sensor 30 including the turning angle sensor 22 and the like (attitude information), and a signal from a switch 29.

The control lever 32, the monitor 31, and the switch 29 are each disposed inside of the cab 4 and can be operated by an operator or the like. The control lever 32 sends an instruction on an operation amount of each actuator (11, 12, 13, 14, 15*a*, 15*b*) to the controller 27. The monitor 31 is used for setting a work area of the work assistance function, for setting a stop area, a deceleration area, and a notification area of the operation assistance function, and for switching between enabled and disabled states of the operation assistance function. That is, the monitor 31 functions as a switching device for switching between enabled and disabled states of the operation assistance function in the present embodiment. The switch 29 is used to switch between enabled and disabled states of the work assistance function. That is, the switch 29 functions as a switching device for switching between enabled and disabled states of the work assistance function in the present embodiment. The buzzer (notification unit) 28 is used to notify the operator or the like of an obstacle, when detected by the detection device 25, via a sound (notification sound).

Figure 4:
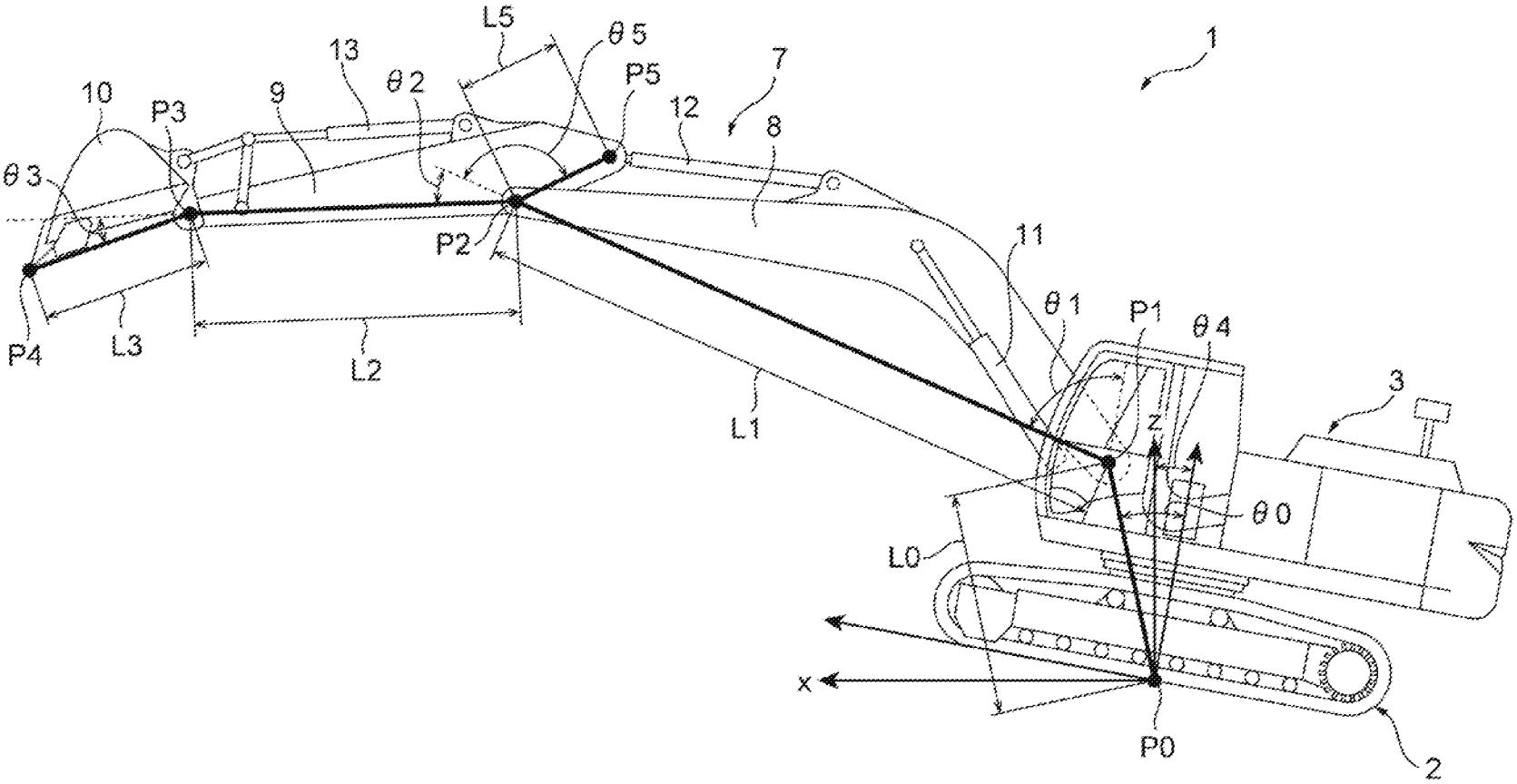
FIG. 4 is a side view illustrating attitude information of the hydraulic excavator.

FIG. 4 is a side view illustrating attitude information of the hydraulic excavator 1. Positional information (this may also be called "body position") P0 of the hydraulic excavator 1 can be obtained based on the information from the first GNSS antenna 23 and the second GNSS antenna 24.

As shown in FIG. 4, the distance from the positional information P0 of the hydraulic excavator 1 to the boom pin P1 is L0, and the angle defined by the upward direction of the body and the direction of the boom pin P1 is θ0. The length of the boom 8, that is, the length from the boom pin P1 to the arm pin P2, is L1. The length of the arm 9, that is, the length from the arm pin P2 to the bucket pin P3, is L2. The length of the bucket 10, that is, the length from the bucket pin P3 to the bucket end P4, is L3. The body inclination with respect to the global coordinate system, that is, the angle defined by the vertical direction of the body with respect to the vertical direction to the horizontal plane, is θ4. Hereinafter, this angle will be referred to as the body longitudinal inclination θ4. The angle defined by the segment connecting the boom pin P1 and the arm pin P2 and the vertical direction of the body is θ1. Hereinafter, this angle will be referred to as the boom angle θ1. The angle defined by the segment connecting the arm pin P2 and the bucket pin P3 and the straight line between the boom pin P1 and the arm pin P2 is θ2. Hereinafter, this angle will be referred to as the arm angle θ2. The angle defined by the segment connecting the bucket pin P3 and the bucket end P4 and the straight line between the arm pin P2 and the bucket pin P3 is θ3. Hereinafter, this angle will be referred to as the bucket angle θ3.

For example, coordinates of the bucket end P4, which may be a target point to be controlled by the work assistance function with respect to the body position P0, can be obtained by trigonometric functions based on the distance L0 from the body position P0 to the boom pin P1, the angle θ0 defined by the body position P0 and the boom pin P1, the body longitudinal inclination θ4, the boom length L1, the boom angle θ1, the arm length L2, the arm angle θ2, the bucket length L3, and the bucket angle θ3.

In addition, coordinates of other control points, for example, the pin P5 on the rod side of the arm cylinder 12, can be obtained by trigonometric functions based on the distance L5 from the arm pin P2 to the pin P5 on the rod side of the arm cylinder 12, and the angle θ5 defined by the direction from the boom pin P1 to the arm pin P2 and the direction from the arm pin P2 to the pin P5 on the rod side of the arm cylinder 12, in addition to the aforementioned dimensions.

The above-described angle information of the hydraulic excavator 1, including the body longitudinal inclination θ4, the boom angle θ1, the arm angle θ2, the bucket angle θ3, and the like, can be obtained based on the information from the body inclination sensor 18, the boom inclination sensor 19, the arm inclination sensor 20, and the bucket inclination sensor 21, for example.

Figure 5:
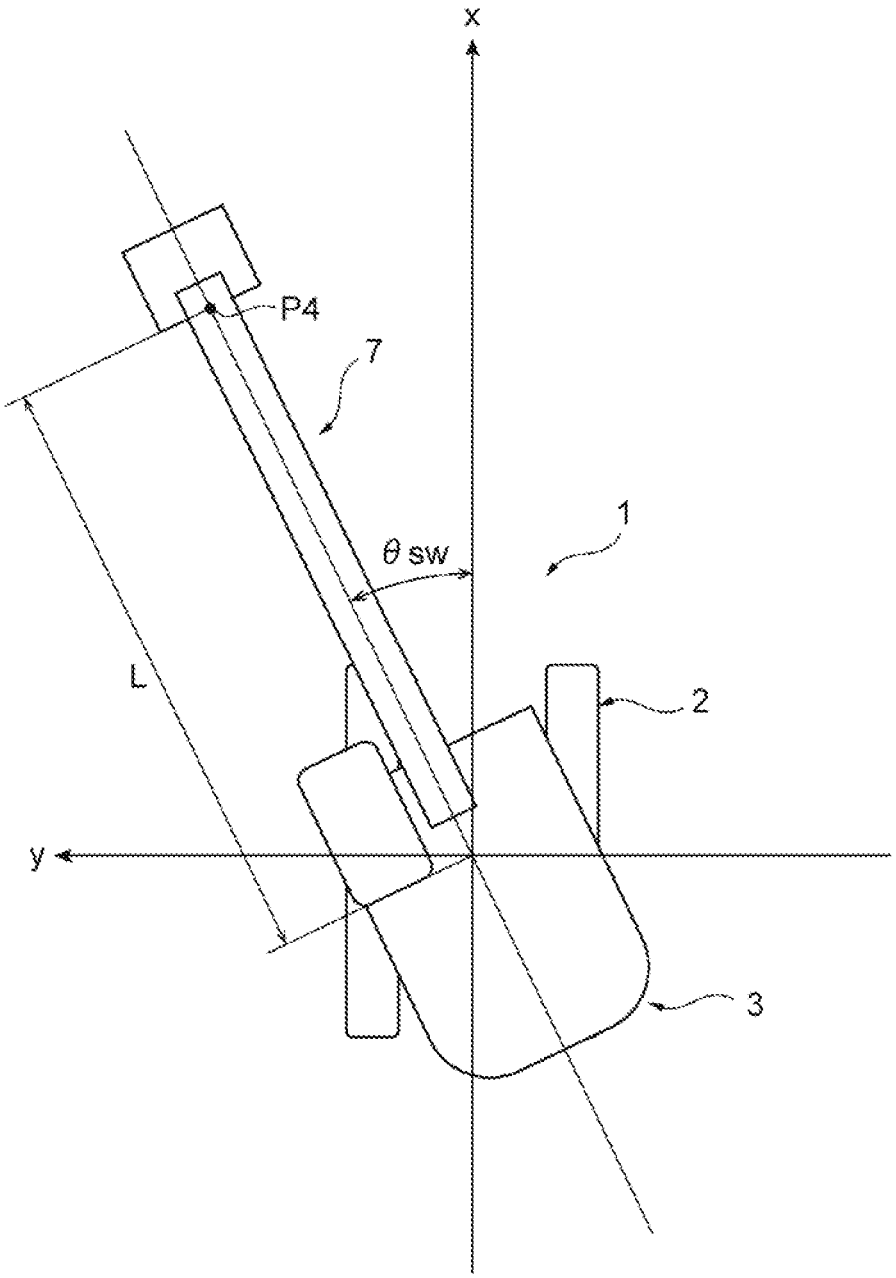
FIG. 5 is a top view illustrating attitude information of the hydraulic excavator.

FIG. 5 is a top view illustrating attitude information of the hydraulic excavator 1. The forward direction and the right-left direction relative to the center position of the traveling body 2 are denoted by x and y, respectively. The turning angle θsw of the hydraulic excavator 1 is an angle defined by the direction of the work implement 7 of the hydraulic excavator 1 relative to the x direction, and an angle in the counterclockwise direction is positive.

For example, coordinates of the bucket end (claw top position) P4 in the body coordinates can be obtained by trigonometric functions based on the distance L from the body position P0 to the bucket end P4 and the turning angle θsw. The distance L from the body position P0 to the bucket end P4 can be calculated by trigonometric functions using the above-described attitude information of the hydraulic excavator 1. The turning angle θsw can be obtained based on the information from the turning angle sensor 22, for example.

In this way, the information (specifically, the control point positional information) obtained from the attitude sensor 30 including the turning angle sensor 22, the GNSS antennas (23, 24), and the inclination sensors (18, 19, 20, 21) is input to the controller 27 as the attitude information of the body.

(Operation Assistance Function)

With reference to FIG. 6 to FIG. 10, the operation assistance function provided in the controller 27 of the hydraulic excavator 1 will be described. Basically, the operation assistance function operates based on the detection information from the detection device 25 that detects an object (obstacle) around the hydraulic excavator 1.

Figure 6:
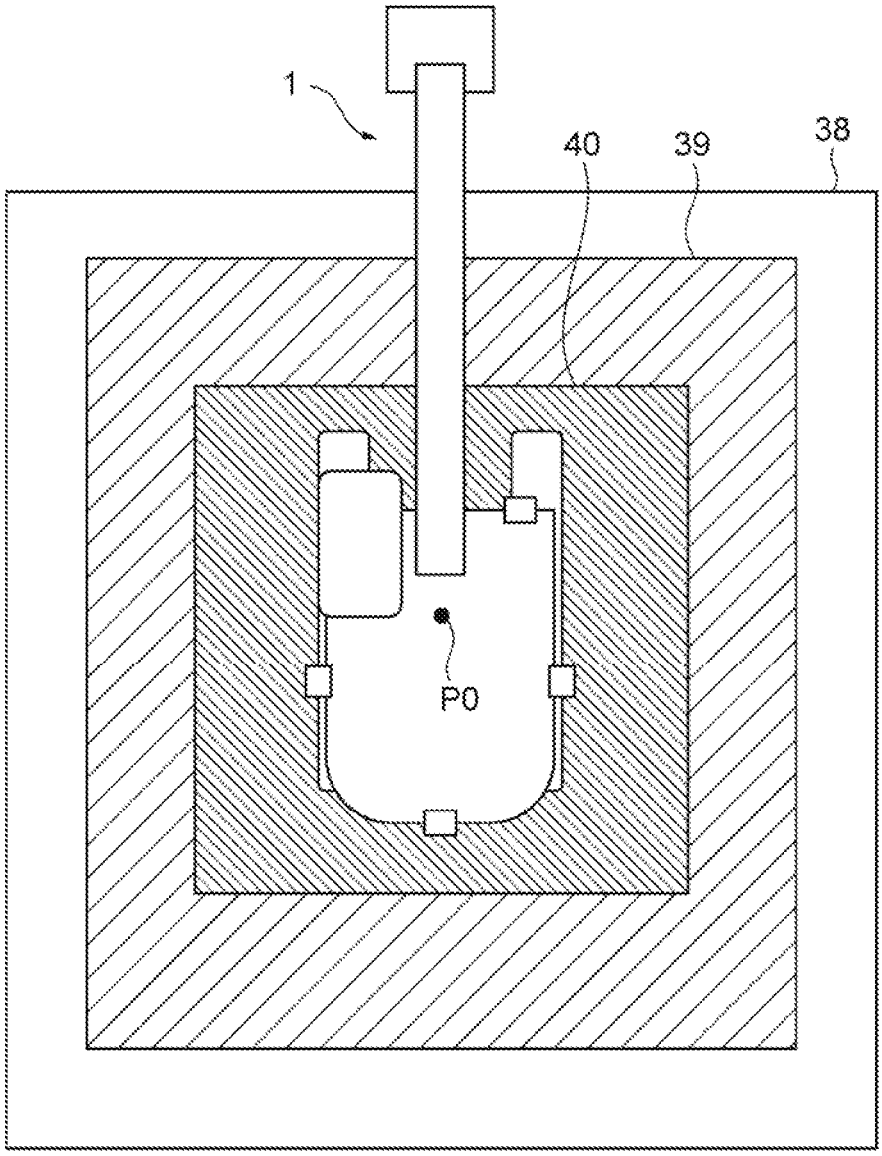
FIG. 6 is a diagram illustrating areas of an operation assistance function.

FIG. 6 is a diagram illustrating areas of the operation assistance function. An area 38 enclosed by a rectangle in FIG. 6 is a notification area. When an object is detected in this area 38, a notification sound is emitted from the buzzer 28 to an operator or the like.

An area 39 enclosed by dotted lines is a deceleration area. When an object is detected in this area 39, the operation of the hydraulic excavator 1 is decelerated, and a notification sound is emitted from the buzzer 28.

An area 40 enclosed by diagonal lines is a stop area. When an object is detected in this area 40, the operation of the hydraulic excavator 1 is stopped, and a notification sound is emitted from the buzzer 28.

In the example shown in FIG. 6, the deceleration area 39 is inside of the notification area 38, and the stop area 40 is inside of the deceleration area 39. In other words, the deceleration area 39 is outside of the stop area 40, and the notification area 38 is outside of the deceleration area 39. However, the areas of the operation assistance function can be set at any positions. In addition, the shape of each area of the operation assistance function need not be a rectangle, and any shape can be set.

The areas of the operation assistance function are fixed with respect to the coordinates P0 of the traveling body 2, and will not move even through the turning operation of the hydraulic excavator 1. In the traveling operation of the hydraulic excavator 1, the areas of the operation assistance function simultaneously move along with the movement of the hydraulic excavator 1. It should be noted that the areas of the operation assistance function may be defined with respect to the global coordinates. In this case, the areas of the operation assistance function will not move even through the traveling operation of the hydraulic excavator 1.

FIG. 7 is a table showing the relation between a detection of an object in each area of the operation assistance function and a notification sound level of the buzzer 28. When an object is detected outside of the notification area 38, there is no notification from the buzzer 28. When an object is detected inside of the notification area 38, there is a notification at a low sound level from the buzzer 28. When an object is detected inside of the deceleration area 39, there is a notification at a medium sound level from the buzzer 28. When an object is detected inside of the stop area 40, there is a notification at a high sound level from the buzzer 28. This allows the operator or the like to intuitively understand where the object (detected object) is located.

Figure 8:
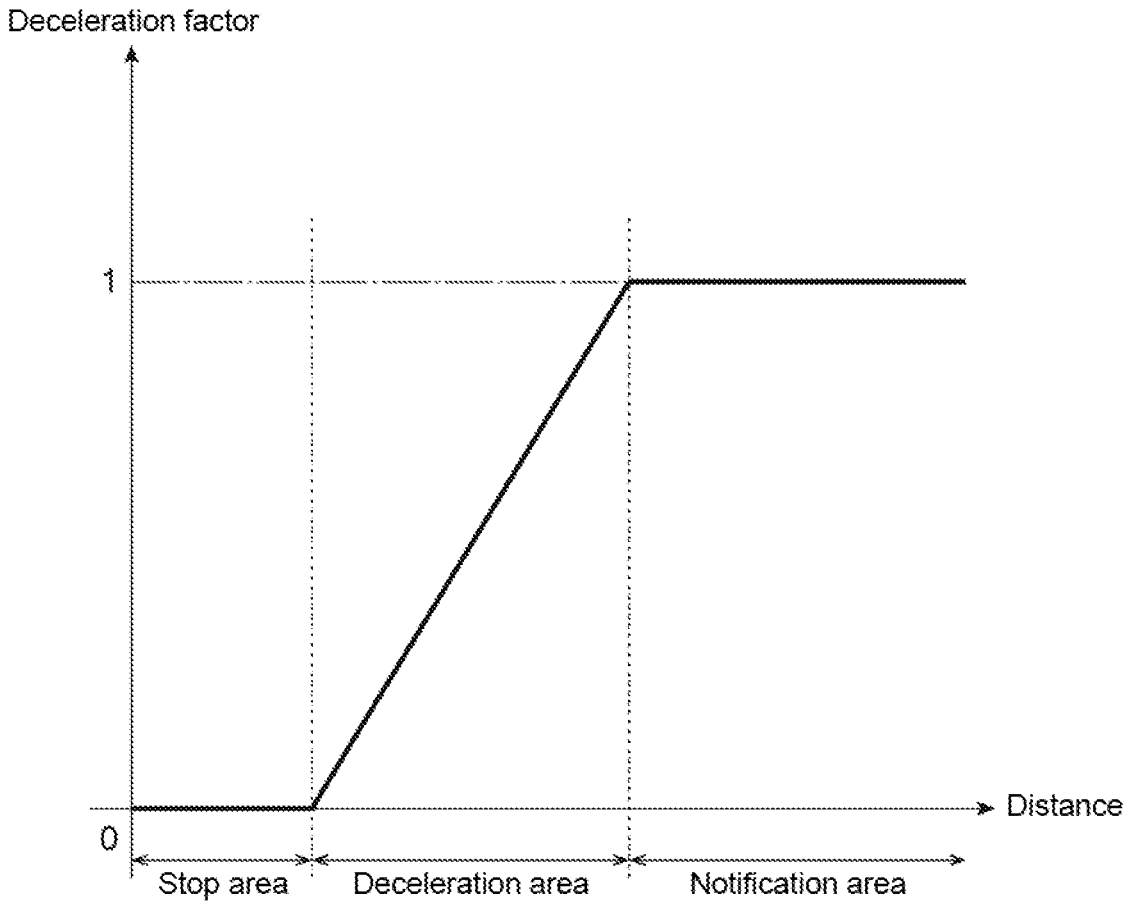
FIG. 8 is a graph showing the relation between a distance from the hydraulic excavator to an object and a deceleration factor of the hydraulic excavator of the operation assistance function.

FIG. 8 is a graph showing the relation between a distance from the hydraulic excavator 1 to an object and a deceleration factor of the hydraulic excavator 1 of the operation assistance function. When an object is detected inside of the deceleration area and the stop area, decreasing the deceleration factor according to the distance from the hydraulic excavator 1 to the object can prevent the hydraulic excavator 1 from coming into contact with the object. Herein, the deceleration factor indicates how much a required speed of the actuator determined based on the operation amount of the control lever 32 should be reduced, and the speed limit of the actuator can be obtained by the product of the required speed and the deceleration factor. For example, when the deceleration factor is 1, the required speed of the actuator is not limited. When the deceleration factor is 0, the speed limit is 0, and the operation of the actuator stops.

Figure 9:
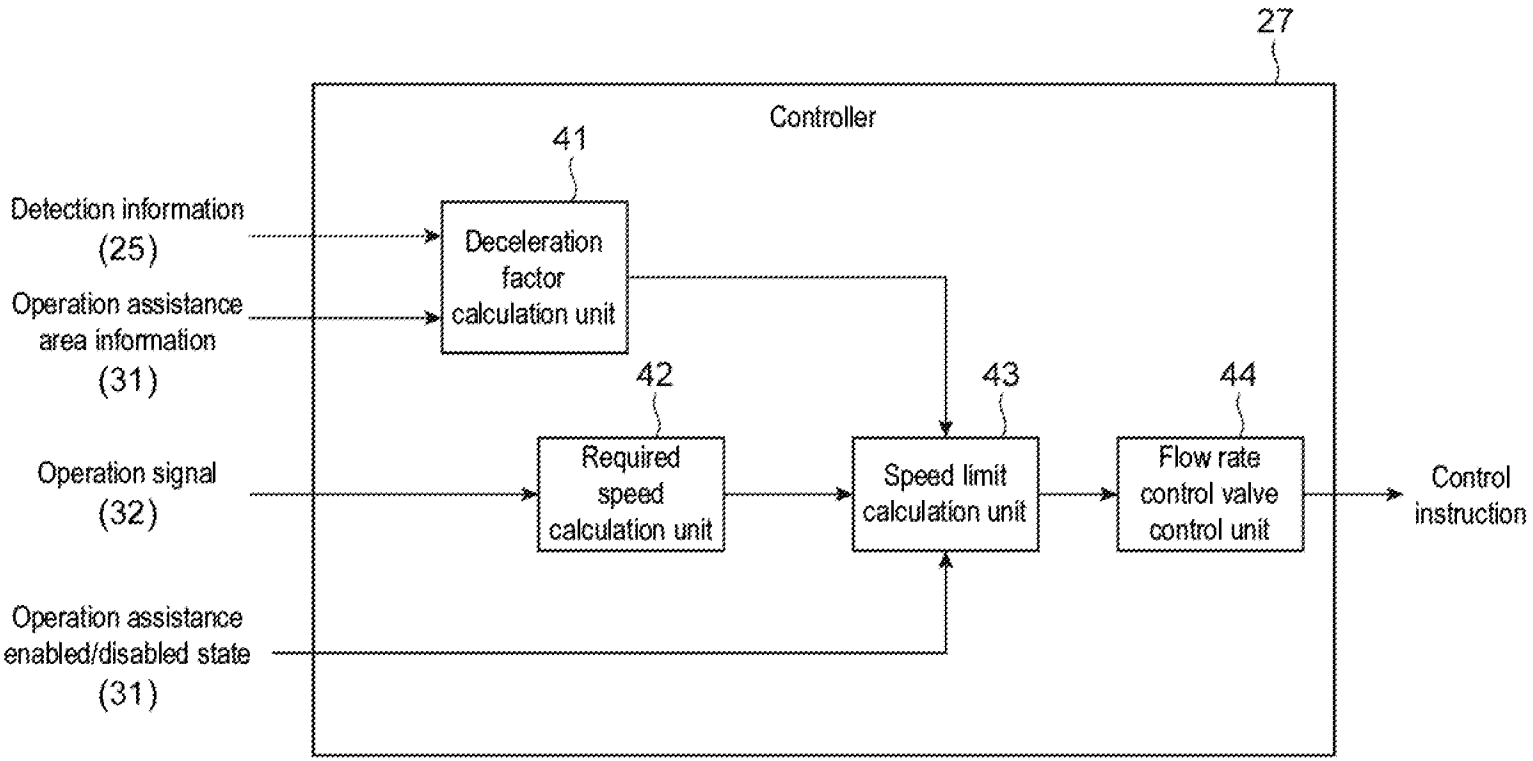
FIG. 9 is a block diagram of the configuration of the operation assistance function.

FIG. 9 is a block diagram of the configuration of the operation assistance function. The operation assistance function inside of the controller 27 includes a deceleration factor calculation unit 41, a required speed calculation unit 42, a speed limit calculation unit 43, and a flow rate control valve control unit 44.

The deceleration factor calculation unit 41 calculates a deceleration factor based on the detection information from the detection device 25 and the operation assistance area information set on the monitor 31 (setting information on each area of the operation assistance function) (see FIG. 8). The required speed calculation unit 42 calculates a required speed of each actuator based on an operation signal (operation amount) from the control lever 32. The speed limit calculation unit 43 calculates and outputs a speed limit of each actuator based on the deceleration factor received from the deceleration factor calculation unit 41, the required speed received from the required speed calculation unit 42, and the operation assistance enabled/disabled state set on the monitor 31 (whether the operation assistance function is in an enabled state or disabled state). When the operation assistance function is in an enabled state, the speed limit calculation unit 43 sets the speed limit of each actuator by multiplying the required speed of each actuator received from the required speed calculation unit 42 by the deceleration factor received from the deceleration factor calculation unit 41. When the operation assistance function is in a disabled state, the speed limit calculation unit 43 outputs the required speed of each actuator received from the required speed calculation unit 42 directly as the speed limit. The flow rate control valve control unit 44 calculates a control amount of the flow rate control valve of each actuator based on the speed limit received from the speed limit calculation unit 43, and outputs a control instruction to the solenoid proportional pressure reducing valve corresponding to each actuator.

With such a configuration, the operation assistance function of the controller 27 can control each actuator so as to decelerate or stop the operation of the hydraulic excavator 1 when an object is detected in each area of the operation assistance function set in advance based on the detection information from the detection device 25.

Figure 10:
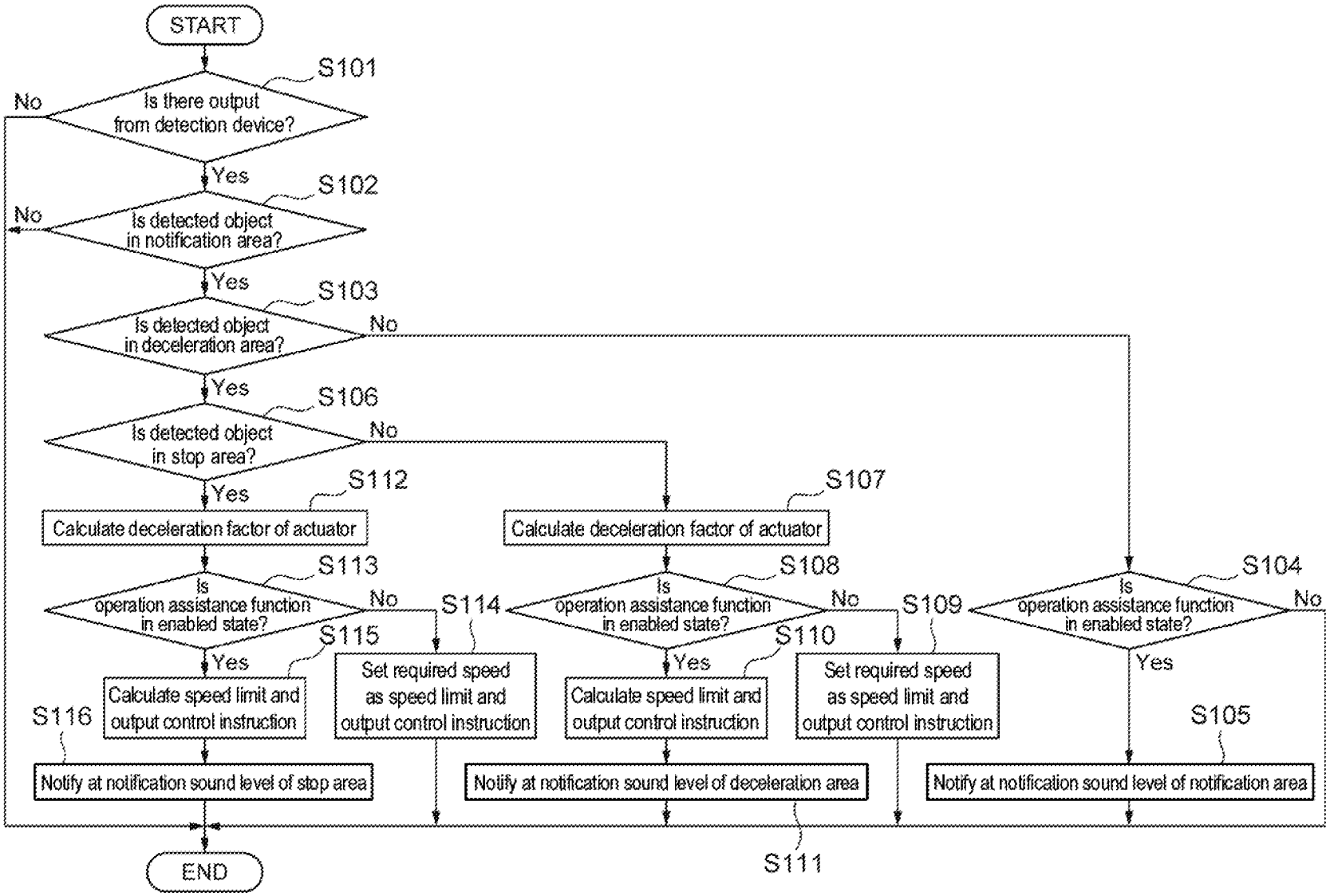
FIG. 10 is a flowchart of the operation assistance function.

FIG. 10 is a flowchart of the operation assistance function. In step S101, it is determined whether there is an output from the detection device 25. If a determination result of step S101 is No, the operation assistance function directly ends. If a determination result of step S101 is Yes, the process proceeds to step S102, where it is determined whether a detected object is in a notification area. If a determination result of step S102 is No, the operation assistance function directly ends. If a determination result of step S102 is Yes, the process proceeds to step S103, where it is determined whether a detected object is in a deceleration area. If a determination result of step S103 is No, the process proceeds to step S104, where it is determined whether the operation assistance function is in an enabled state based on an output from the monitor 31. If a determination result of step S104 is No, the operation assistance function directly ends. If a determination result of step S104 is Yes, the process proceeds to step S105, where a notification sound is output from the buzzer 28 at a set sound level (FIG. 7) of the notification area, and the operation assistance function ends.

If a determination result of step S103 is Yes, the process proceeds to step S106, where it is determined whether a detected object is in a stop area. If a determination result of step S106 is No, the process proceeds to step S107, where a deceleration factor of an actuator is calculated according to the position of the detected object. Next, in step S108, it is determined whether the operation assistance function is in an enabled state based on an output from the monitor 31. If a determination result of step S108 is No, the process proceeds to step S109, where the required speed of the actuator is directly set as the speed limit of the actuator, and a control instruction is output to the solenoid proportional pressure reducing valve corresponding to the actuator and the process ends. That is, in step S109, the operation assistance function directly ends. If a determination result of step S108 is Yes, the process proceeds to step S110, where a speed limit of the actuator is calculated based on the deceleration factor of the actuator and the required speed of the actuator, and a control instruction is output to the solenoid proportional pressure reducing valve corresponding to the actuator. Next, in step S111, a notification sound is output from the buzzer 28 at a notification sound level (FIG. 7) of the deceleration area and the process ends.

If a determination result of step S106 is Yes, the process proceeds to step S112, where a deceleration factor (0 herein) of the actuator is calculated. Next, in step S113, it is determined whether the operation assistance function is in an enabled state based on an output from the monitor 31. If a determination result of step S113 is No, the process proceeds to step S114, where the required speed of the actuator is directly set as the speed limit of the actuator, and a control instruction is output to the solenoid proportional pressure reducing valve corresponding to the actuator and the process ends. That is, in step S114, the operation assistance function directly ends. If a determination result of step S113 is Yes, the process proceeds to step S115, where a speed limit of the actuator is calculated based on the deceleration factor of the actuator and the required speed of the actuator, and a control instruction is output to the solenoid proportional pressure reducing valve corresponding to the actuator. Finally, the process proceeds to S116, where a notification sound is output from the buzzer 28 at a notification sound level (FIG. 7) of the stop area and the process ends.

(Work Assistance Function)

With reference to FIG. 11 to FIG. 17, the work assistance function provided in the controller 27 of the hydraulic excavator 1 will be described. Basically, the operation assistance function operates based on the attitude information of the hydraulic excavator 1 from the attitude sensor 30 including the turning angle sensor 22 and the like.

Figure 11:
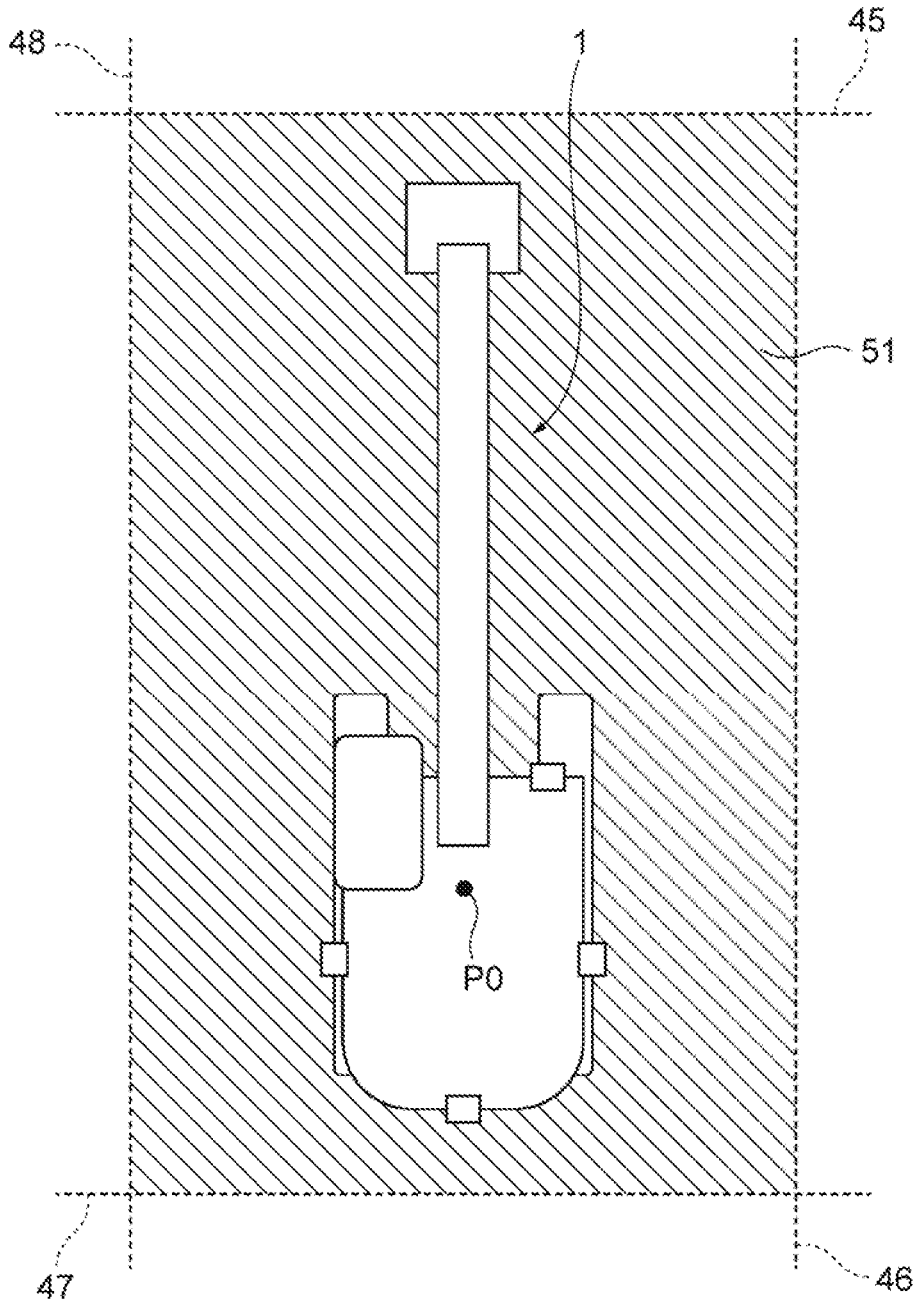
FIG. 11 is a diagram illustrating a work area of a work assistance function in a horizontal direction of the body.

FIG. 11 is a diagram illustrating a work area of the work assistance function in a horizontal direction of the body. A diagonally-lined area 51, which is surrounded by a front side work area 45, a right side work area 46, a rear side work area 47, and a left side work area 48 around the body position P0 as the center, is a work area. The actuator is controlled so that the control point of the work machine does not go out of the work area 51. In addition, since the body position P0 is set as the center, the work area moves along with the movement of the hydraulic excavator 1 when the hydraulic excavator 1 performs traveling operation. The work area may be defined by the global coordinates. In this case, the work area will not move even when the hydraulic excavator 1 moves through the traveling operation.

Figure 12:
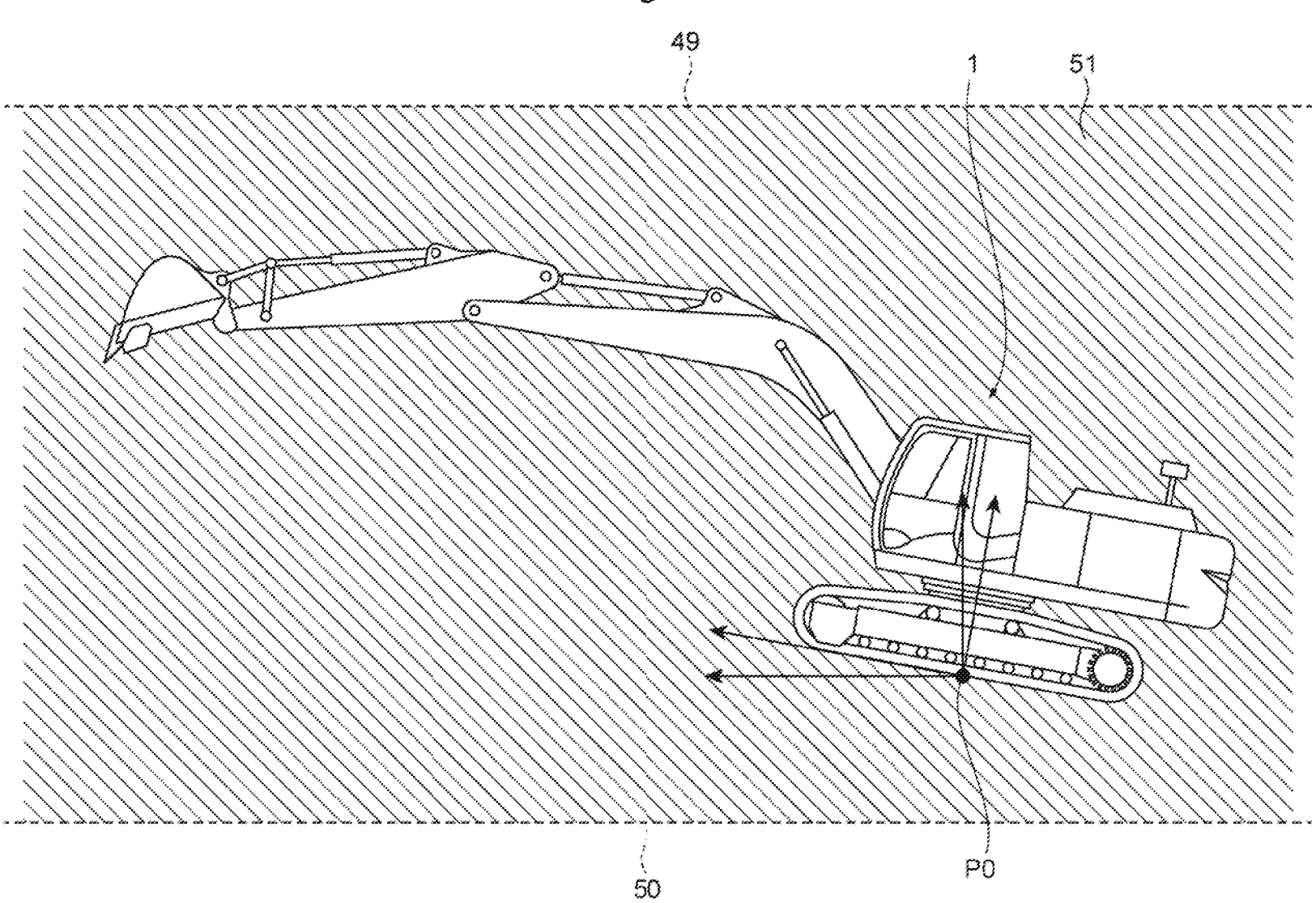
FIG. 12 is a diagram illustrating a work area of the work assistance function in a vertical direction of the body.

FIG. 12 is a diagram illustrating a work area of the work assistance function in a vertical direction of the body. The diagonally-lined area 51, which is inside of an upper side work area 49 and a lower side work area 50 around the body position P0 as the center, is a work area.

Figure 13:
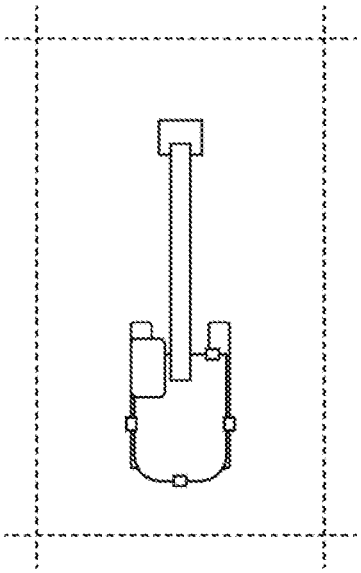
FIG. 13 is a diagram illustrating setting screens of the work area of the work assistance function.
Figure 13:
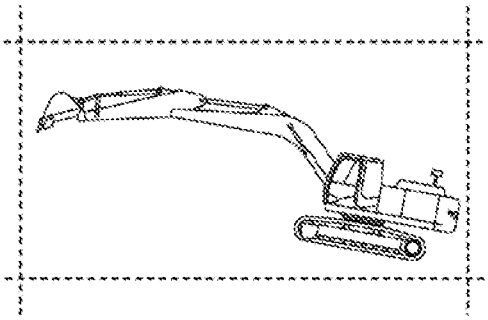

FIG. 13 is a diagram illustrating setting screens of the work area of the work assistance function. For example, the screens as shown in FIG. 13 are displayed on the monitor 31 provided in the cab 4 of the hydraulic excavator 1. On the monitor 31, distances from the body position P0 to the right side work area 46, to the left side work area 48, to the front side work area 45, to the rear side work area 47, to the upper side work area 49, and to the lower side work area 50 can be set and input. When no value is input, a set area is at infinity, and a direction to which a value is not input will not be controlled.

It should be noted that the shape of the work area of the work assistance function need not be a rectangle, and any shape can be set. In addition, a method for setting a work area of the work assistance function is not limited to the illustrated example.

Figure 14:
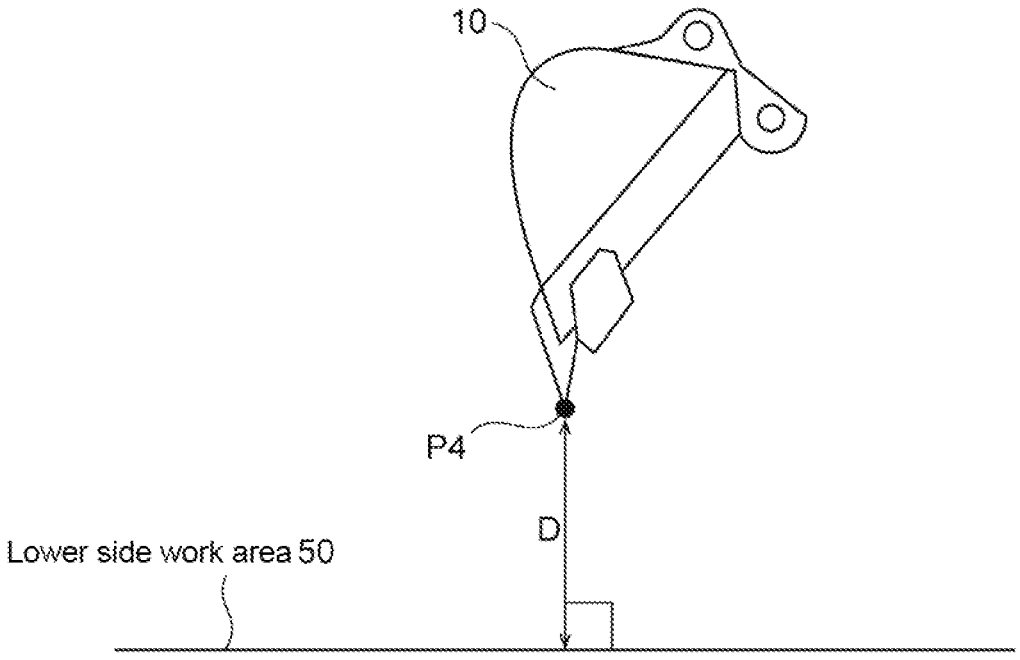
FIG. 14 is a diagram illustrating a distance between a control point and an outer edge of the work area of the work assistance function.
Figure 15:
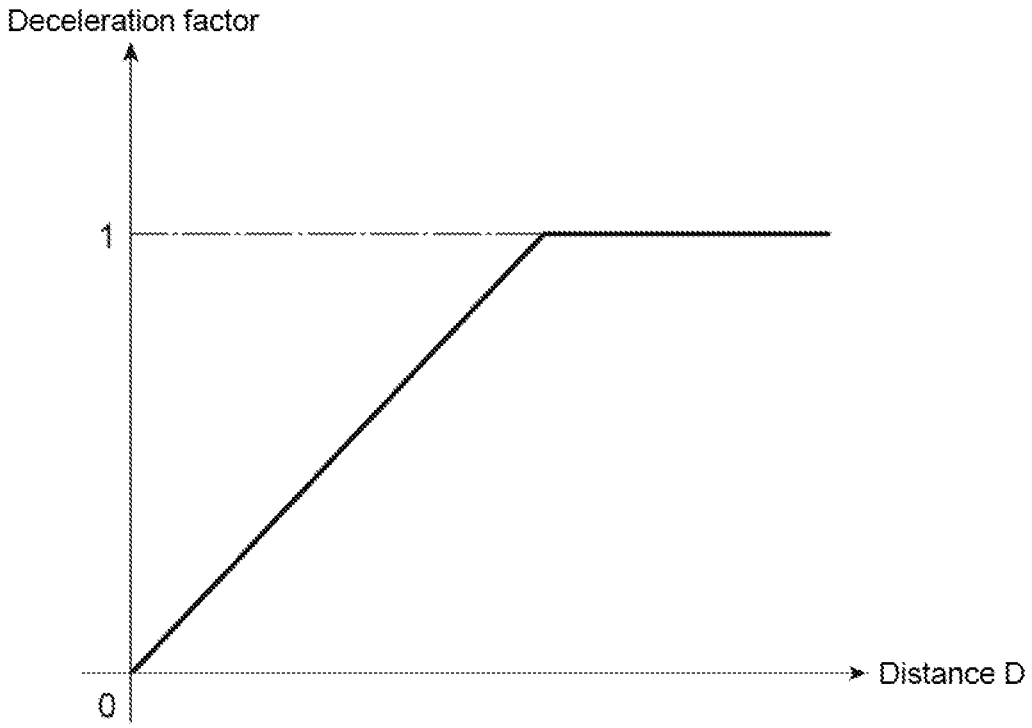
FIG. 15 is a graph showing a deceleration factor of the hydraulic excavator of the work assistance function.

FIG. 14 is a diagram illustrating a distance between a control point and an outer edge of the work area of the work assistance function. FIG. 15 is a graph showing a deceleration factor of the hydraulic excavator of the work assistance function. Assuming that, for example, the bucket end P4 approaches the lower work area 50 as shown in FIG. 14. At this time, the coordinates of the bucket end P4 are calculated by trigonometric functions of the above-described attitude information of the hydraulic excavator 1. The difference between the z coordinate of the bucket end P4 and the set distance to the lower work area 50 is equal to a distance D between the bucket end P4 and the lower work area 50. As shown in FIG. 15, a deceleration factor to reduce the speed when approaching the work area is calculated according to the value of the distance D, and the actuator is driven at a speed limit obtained by multiplication of the speed by the deceleration factor. This can prevent the bucket end P4, as a control point, from going out of the work area. In addition, with respect to the upper side work area 49, for example, the pin P5 on the rod side of the arm cylinder 12 serves as a control point, and through the same calculation as the case of the bucket end P4, it is possible to prevent the pin P5 as the control point from going out of the work area. In addition, when the operations at the plurality of control points are simultaneously limited, the actuator is controlled according to a lower speed limit.

It should be noted that the control point of the work machine used for controlling the actuator may be set in advance by an operator or the like, or may be set through the calculation by the controller 27 based on the attitude information of the hydraulic excavator 1 or the like. Examples of the control point may include the rear end of the turning body 3, the back face of the bucket 10, the end of the entire hydraulic excavator 1 that can be calculated by the controller 27, or the like, in addition to the above-described points.

Figure 16:
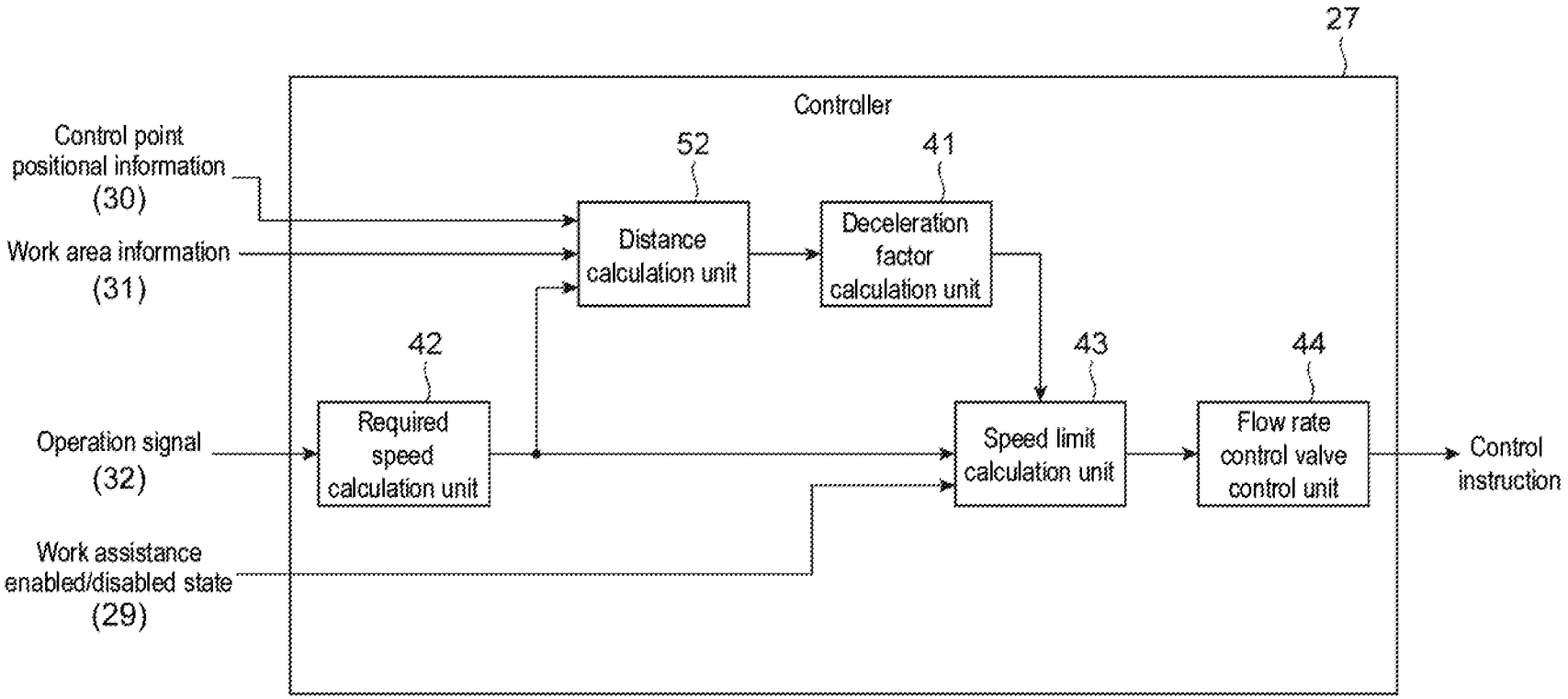
FIG. 16 is a block diagram of the configuration of the work assistance function.

FIG. 16 is a block diagram of the configuration of the work assistance function. With respect to the work assistance function, the controller 27 includes a distance calculation unit 52, the deceleration factor calculation unit 41, the required speed calculation unit 42, the speed limit calculation unit 43, and the flow rate control valve control unit 44.

The required speed calculation unit 42 calculates a required speed of each actuator based on an operation signal (operation amount) received from the control lever 32. The distance calculation unit 52 calculates a distance between a control point and an outer edge of the work area based on the control point positional information obtained from the attitude sensor 30, the work area information (setting information on the work area) set on the monitor 31, and the required speed received from the required speed calculation unit 42. Herein, the required speed is used to obtain a moving direction of the control point, and the distance to the outer edge of the work area in the moving direction of the control point is calculated. The deceleration factor calculation unit 41 calculates a deceleration factor of the actuator based on the distance received from the distance calculation unit 52 (see FIG. 15). The speed limit calculation unit 43 calculates and outputs a speed limit of each actuator based on the deceleration factor received from the deceleration factor calculation unit 41, the required speed received from the required speed calculation unit 42, and the work assistance enabled/disabled state received from the switch 29. When the work assistance function is in an enabled state, the speed limit calculation unit 43 sets the speed limit of each actuator by multiplying the required speed of each actuator received from the required speed calculation unit 42 by the deceleration factor received from the deceleration factor calculation unit 41. When the work assistance function is in a disabled state, the speed limit calculation unit 43 outputs the required speed of each actuator received from the required speed calculation unit 42 directly as the speed limit. The flow rate control valve control unit 44 calculates a control amount of the flow rate control valve corresponding to each actuator based on the speed limit received from the speed limit calculation unit 43, and outputs a control instruction to the solenoid proportional pressure reducing valve corresponding to each actuator.

With such a configuration, the work assistance function of the controller 27 can control each actuator so as to prevent the control point of the hydraulic excavator 1 from going out of the work area of the work assistance function set in advance based on the attitude information (control point positional information) of the hydraulic excavator 1.

Figure 17:
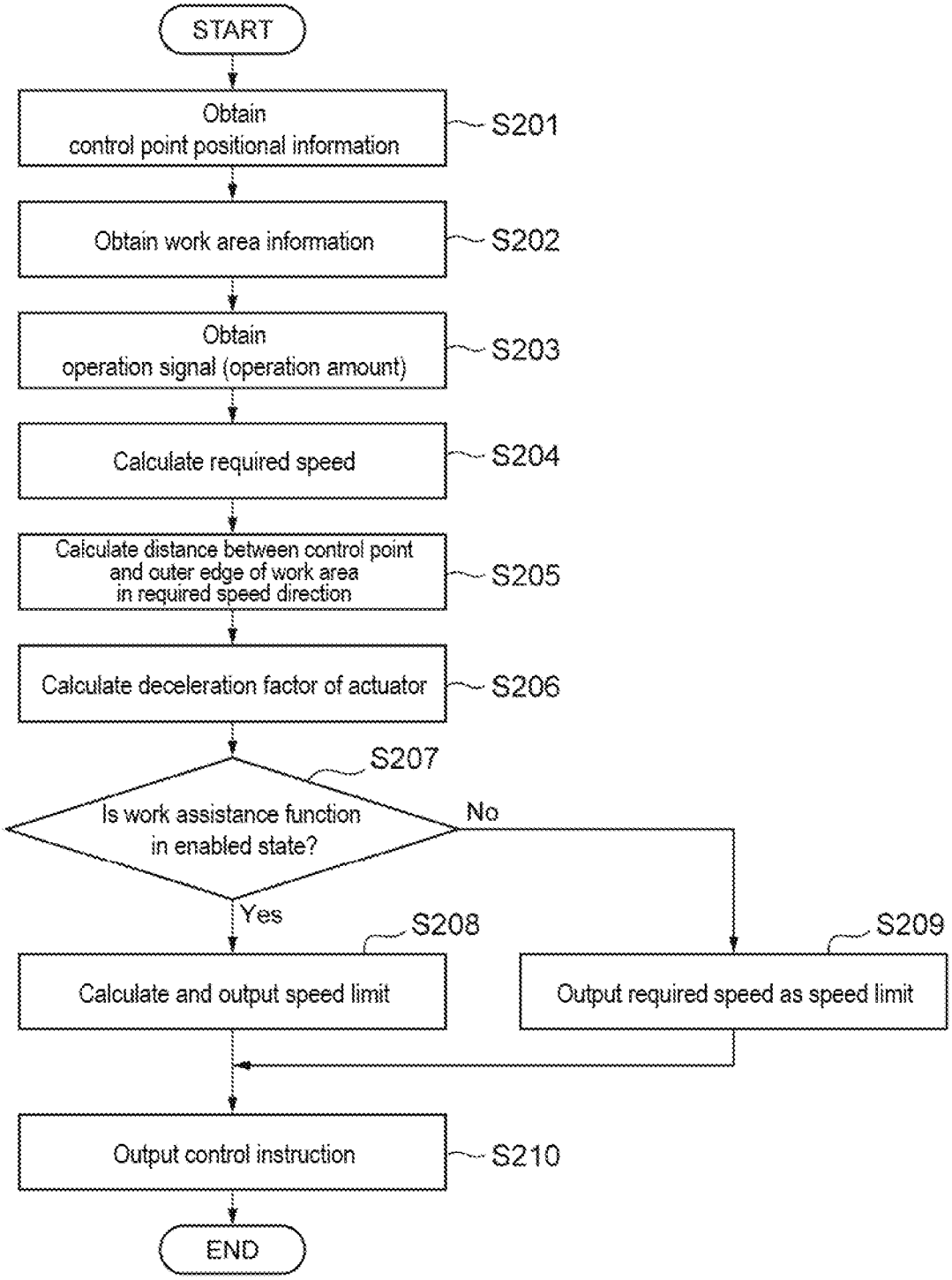
FIG. 17 is a flowchart of the work assistance function.

FIG. 17 is a flowchart of the work assistance function. In step S201, control point positional information is obtained. In step S202, work area information is obtained. In step S203, an operation signal (operation amount) from the control lever 32 is obtained. In step S204, a required speed of each actuator is calculated based on the operation signal (operation amount). In step S205, a distance between a control point and an outer edge of the work area in a required speed direction is calculated. In step S206, a deceleration factor of an actuator is calculated based on the calculated distance. In step S207, it is determined whether the work assistance function is in an enabled state based on an output from the switch 29. If a determination result of step S207 is Yes, the process proceeds to step S208, where a speed limit of the actuator is calculated based on the deceleration factor of the actuator and the required speed of the actuator, and the obtained speed limit is output. If a determination result of step S207 is No, the process proceeds to step S209, where the required speed of the actuator is output directly as the speed limit of the actuator. Finally, in step S210, a control instruction of the solenoid proportional pressure reducing valve corresponding to the actuator is calculated based on the received speed, and the obtained control instruction is output.

(Characteristic Configuration of Operation Assistance Function According to First Embodiment)

Figure 18:
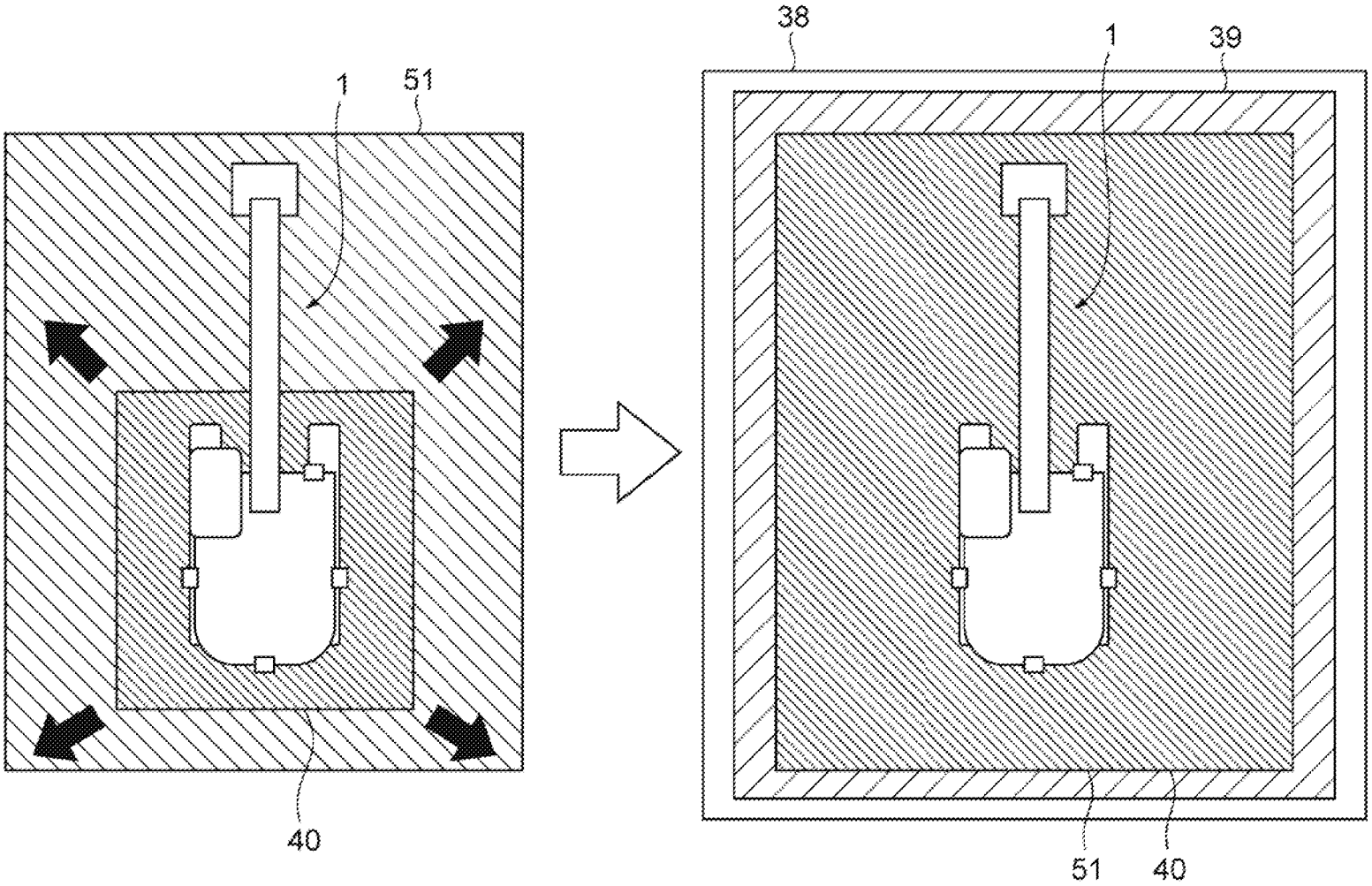
FIG. 18 is a diagram illustrating areas of the operation assistance function according to the first embodiment.
Figure 19:
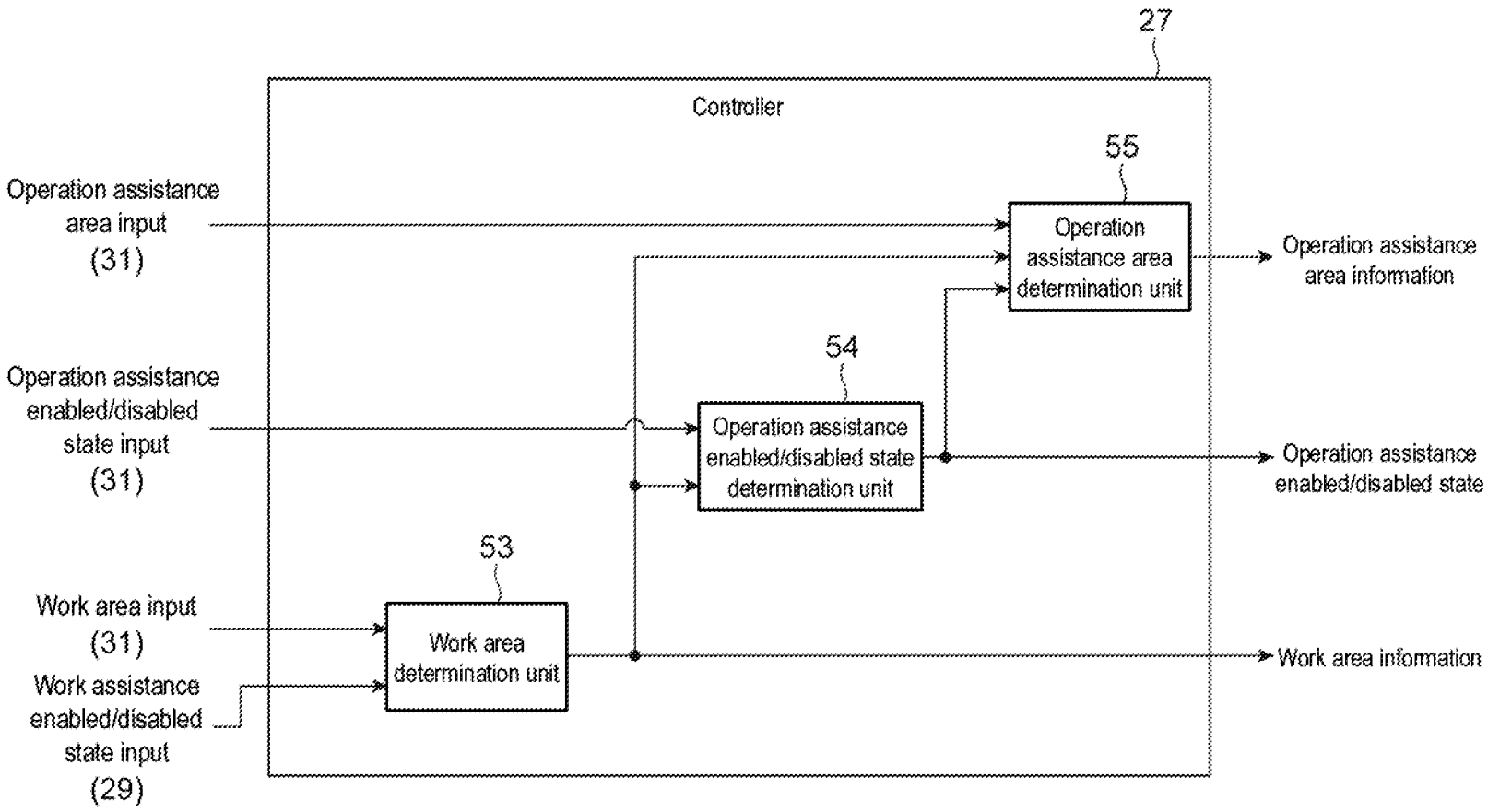
FIG. 19 is a block diagram of the configuration of the operation assistance function according to the first embodiment.

With reference to FIG. 18 and FIG. 19, the characteristic configuration of the operation assistance function provided in the controller 27 of the hydraulic excavator 1 will be described. When the operation assistance function and the work assistance function are incorporated separately, each function may operate as described above. However, when both of the operation assistance function and the work assistance function are incorporated into the controller 27 of the hydraulic excavator 1, the following configuration and operation are added in order to reduce the inconvenience to an operator or the like of setting an area of the operation assistance function and an area of the work assistance function, and to prevent a collision of the work machine with an object in a work area.

FIG. 18 is a diagram illustrating areas of the operation assistance function according to the first embodiment. In the left illustration of FIG. 18, an area 40 enclosed by a rectangle is a stop area of the operation assistance function set on the monitor 31 and an area 51 enclosed by a rectangle is a work area of the work assistance function to be set on the monitor 31.

When the work assistance function is in an enabled state via the switch 29 and the work area 51 is set via the monitor 31, the stop area 40 will be extended from the area shown in the left illustration to the diagonally-lined area shown in the right illustration, and will be set to be overlaid on the work area 51. In other words, the work area 51 set via the monitor 31 will be set as the stop area 40. Specifically, in other words, the stop area 40 will be set (extended) so as to match with the work area 51 set via the monitor 31. At this time, when the operation assistance function is in a disabled state, the operation assistance function will be (automatically) enabled so as to enable the stop area 40 of the operation assistance function, and as described above, the stop area 40 will be set to be overlaid on the work area 51, that is, the work area 51 will be set as the stop area 40. In addition, when the notification area 38 and the deceleration area 39 of the operation assistance function are set, they will further be set outside of the stop area 40 set (extended) as described above.

FIG. 19 is a block diagram of the configuration of the operation assistance function according to the first embodiment. Regarding area setting of the operation assistance function, the controller 27 includes a work area determination unit 53, an operation assistance enabled/disabled state determination unit 54, and an operation assistance area determination unit 55.

The work area determination unit 53 sets a work area based on a work area input set on the monitor 31 and a work assistance enabled/disabled state input that is the input information of the switch 29. When the work assistance function is in an enabled state, the work area determination unit 53 outputs the work area input set on the monitor 31 as work area information. The operation assistance enabled/disabled state determination unit 54 switches between enabled and disabled states of the operation assistance function based on an operation assistance enabled/disabled state input (enabled or disabled setting of the operation assistance function) set on the monitor 31 and the work area information received from the work area determination unit 53. Specifically, even when the operation assistance function is set in a disabled state, when there is an output from the work area determination unit 53, the operation assistance enabled/disabled state determination unit 54 enables the operation assistance function and outputs the setting of the operation assistance function. When there is no output from the work area determination unit 53, the operation assistance enabled/disabled state determination unit 54 directly outputs the setting of the operation assistance function set on the monitor 31. The operation assistance area determination unit 55 calculates and outputs each area of the operation assistance function based on the operation assistance area input (setting information on each area of the operation assistance function) received from the monitor 31, the work area information received from the work area determination unit 53, and the operation assistance enabled/disabled state received from the operation assistance enabled/disabled state determination unit 54 as described with reference to FIG. 18, for example.

The operation assistance area information received from the operation assistance area determination unit 55 and the operation assistance enabled/disabled state received from the operation assistance enabled/disabled state determination unit 54 are used for the calculation process of the operation assistance function as described with reference to FIG. 9, for example. The work area information received from the work area determination unit 53 is used for the calculation process of the work assistance function as described with reference to FIG. 16, for example.

It should be noted that in the above-described embodiment, when the operation assistance function can be switched between enabled and disabled states by the monitor 31, which serves as a switching device for switching between enabled and disabled states of the operation assistance function, and the work assistance function can be switched between enabled and disabled states by the switch 29, which serves as a switching device for switching between enabled and disabled states of the work assistance function, and when the work assistance function is in an enabled state and the work area 51 is set, the controller 27 (or the operation assistance function thereof) enables the operation assistance function (even when the operation assistance function is in the disabled state) and sets the work area 51 as the stop area 40.

However, when the work assistance function cannot be switched between enabled and disabled states, for example, when the work area 51 is set, the controller 27 (or the operation assistance function thereof) may enable the operation assistance function (even when the operation assistance function is in the disabled state) and set the work area 51 as the stop area 40. In addition, when both of the operation assistance function and the work assistance function cannot be switched between enabled and disabled states, for example, when the work area 51 is set, the controller 27 (or the operation assistance function thereof) may set the work area 51 as the stop area 40.

Advantageous Effect

As described above, in the first embodiment, the operation assistance system for a work machine has the operation assistance function of stopping the hydraulic excavator (work machine) 1 when an object is detected in the stop area 40 set in advance based on the detection information from the detection device 25 that detects an object around the hydraulic excavator (work machine) 1 with the work implement 7 and the work assistance function of preventing the hydraulic excavator (work machine) 1 from going out of the work area 51 set in advance based on the attitude information of the hydraulic excavator (work machine) 1. When both of the operation assistance function and the work assistance function can be switched between enabled and disabled states, and when the work assistance function is in an enabled state and the work area 51 is set, the operation assistance system enables the operation assistance function and sets the work area 51 as the stop area 40.

In addition, when the deceleration area 39 is set outside of the stop area 40 and an object is detected in the deceleration area 39 based on the detection information from the detection device 25, the operation assistance system decelerates the hydraulic excavator (work machine) 1.

In addition, when the notification area 38 is set outside of the stop area 40 and an object is detected in the notification area 38 based on the detection information from the detection device 25, the operation assistance system makes a notification from the buzzer (notification unit) 28 provided in the operation assistance system.

According to the first embodiment, when the work area 51 is set, the operation assistance system sets the work area 51 as the stop area 40. Thus, in the operation assistance system for a work machine having both operation assistance and work assistance functions, it is possible to reduce the inconvenience to an operator or the like of setting an area of the operation assistance function and an area of the work assistance function (in particular, an area of the operation assistance function), and prevent a collision of the work machine with an object in a work area.

Second Embodiment

Figure 20:
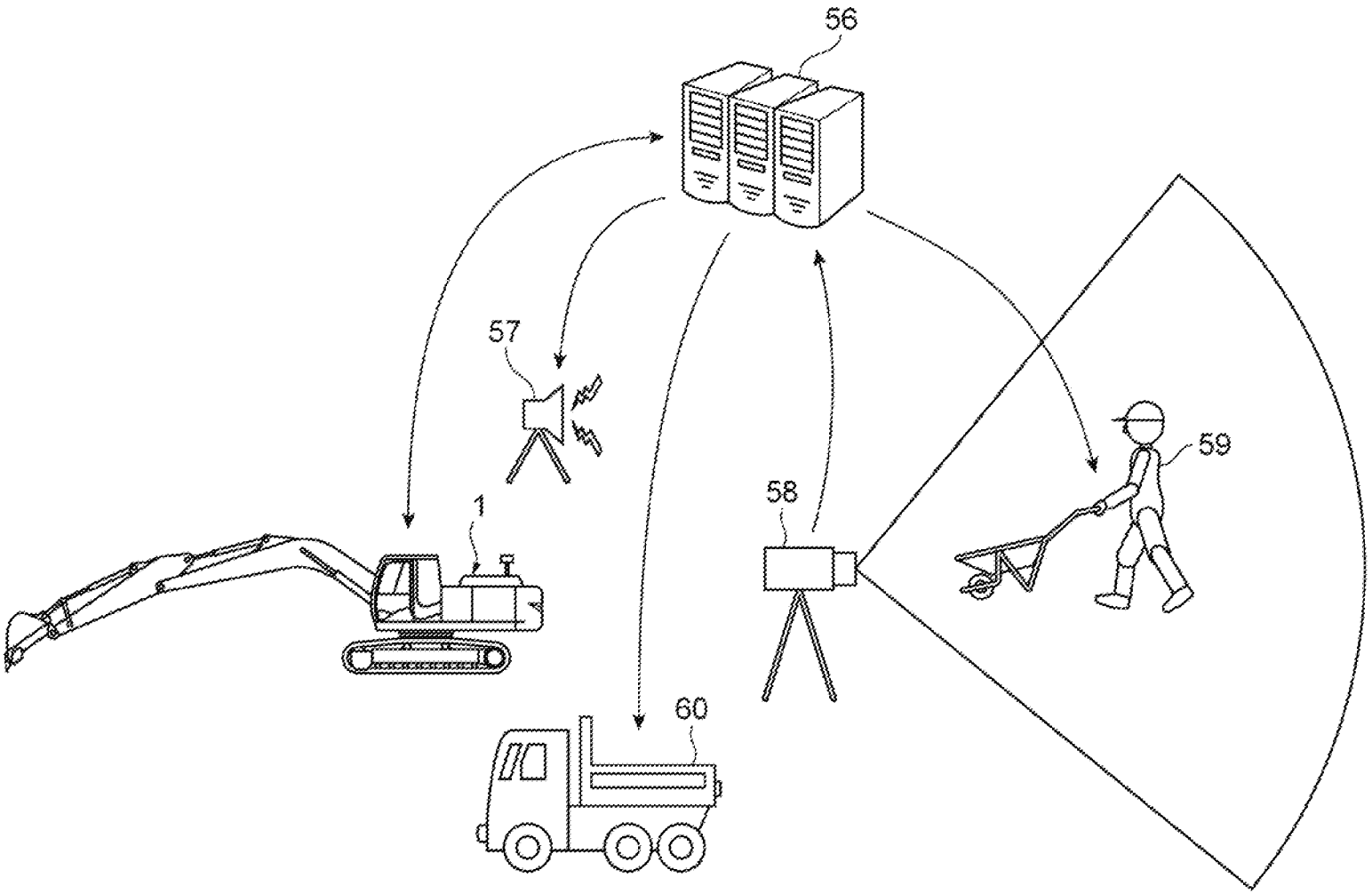
FIG. 20 is a diagram illustrating a construction site according to a second embodiment.

FIG. 20 is a diagram illustrating a construction site according to a second embodiment. In the first embodiment, relevant devices are configured to be mounted on the hydraulic excavator 1 basically. However, the relevant devices may be configured to be partially disposed outside of the hydraulic excavator.

For example, as a variation of the configuration of the hydraulic excavator of the first embodiment, the hydraulic excavator 1 may receive, via communication with a server 56, positional information (detection information) of a worker 59 around the body as an output from a detection device 58 disposed outside of the body. In addition, the hydraulic excavator 1 may receive, via communication with the server 56, positional information and attitude information of the hydraulic excavator 1 as an output from a detection device (not shown) disposed outside of the body. In addition, an enabled or disabled state of the work assistance function of the hydraulic excavator 1 may be set from the outside of the body via the server 56, not via the switch 29. In addition, a work area of the work assistance function or areas of the operation assistance function of the hydraulic excavator 1, or an enabled or disabled state of the operation assistance function of the hydraulic excavator 1 may be set from the outside of the body via the server 56, not via the monitor 31. In addition, the hydraulic excavator 1 may be remotely operated from the outside of the body (control tower or cockpit) via the server 56, not via the control lever 32 disposed inside of the cab 4. In addition, the server 56 may calculate a notification instruction and a control instruction of the solenoid proportional pressure reducing valve and the like based on the work area of the work assistance function or the areas of the operation assistance function and the detection information of the object, and transmit them to the hydraulic excavator 1. In addition, when a worker 59 or a dump truck 60 is detected in the notification area 38, a notification of its entry into the notification area 38 may be made from a notification unit (not shown) worn by the worker 59, a notification unit 57 disposed at the site, or a notification unit (not shown) in the dump truck 60. In addition, the hydraulic excavator 1 may directly communicate with the detection device 58 or other devices, not via the server 56.

Figure 21:
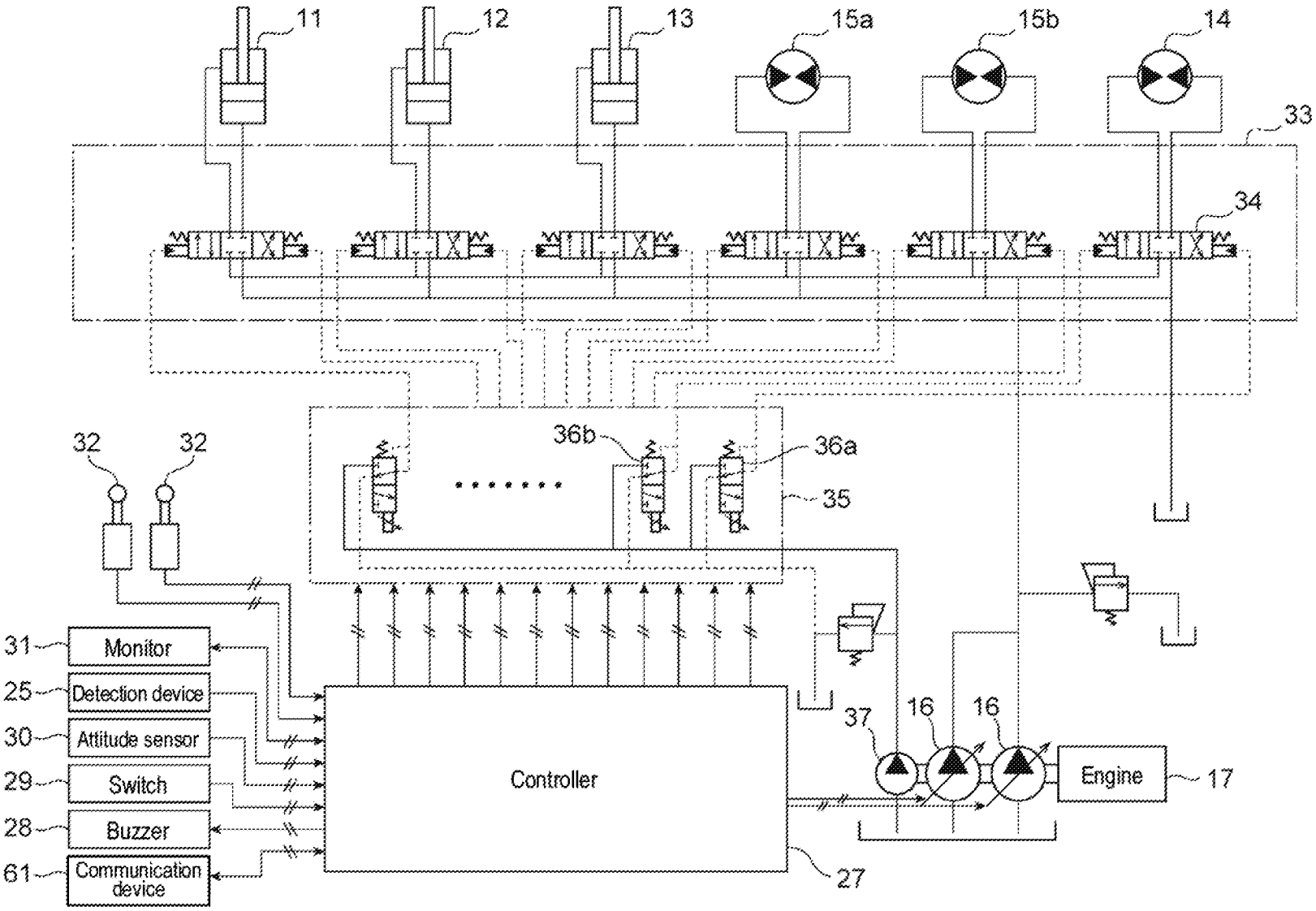
FIG. 21 is a system configuration diagram of the hydraulic excavator according to the second embodiment.

FIG. 21 is a system configuration diagram of the hydraulic excavator according to the second embodiment. In addition to the system configuration of the first embodiment, the hydraulic excavator additionally includes a communication device 61. The controller 27 can exchange information with the above-described external sensors and the server 56 via the communication device 61.

Figure 22:
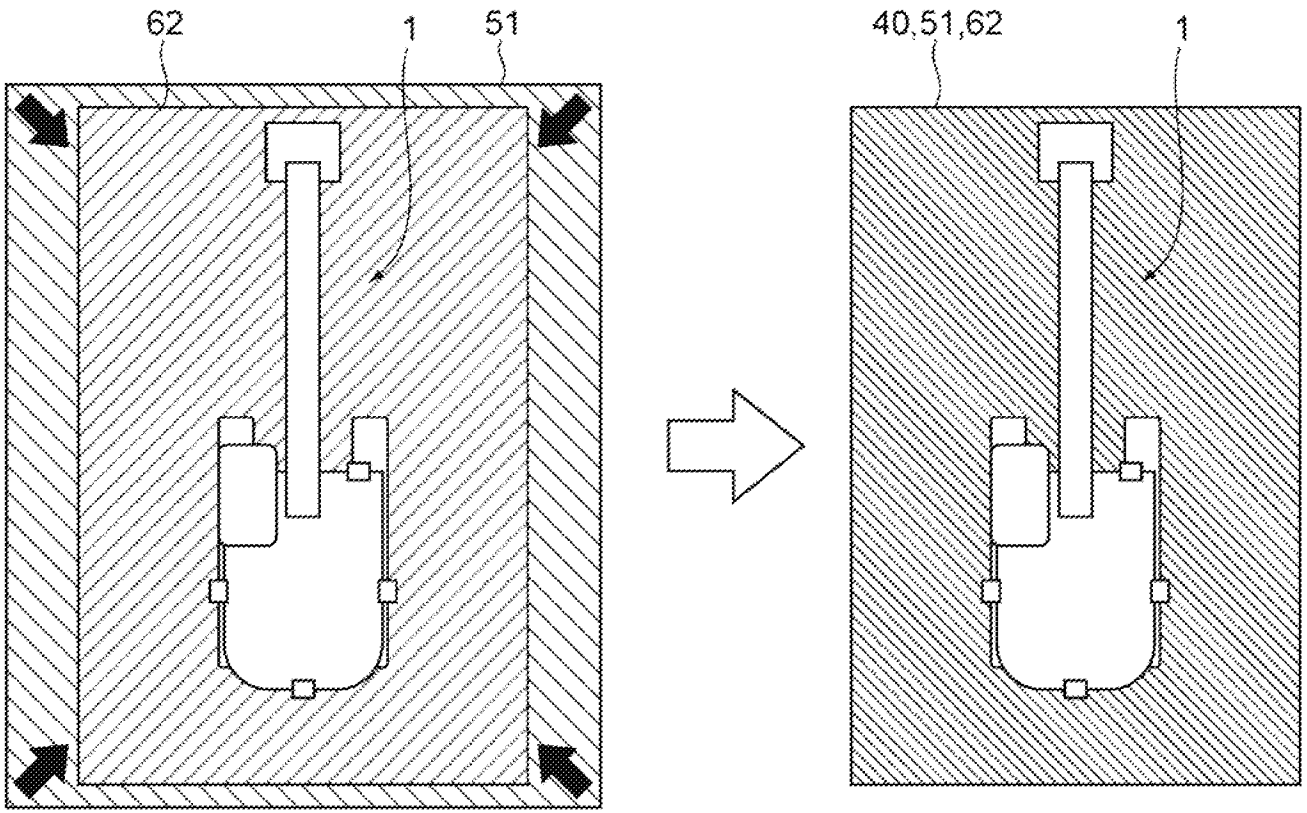
FIG. 22 is a diagram illustrating an area of the operation assistance function according to the second embodiment (first example).
Figure 23:
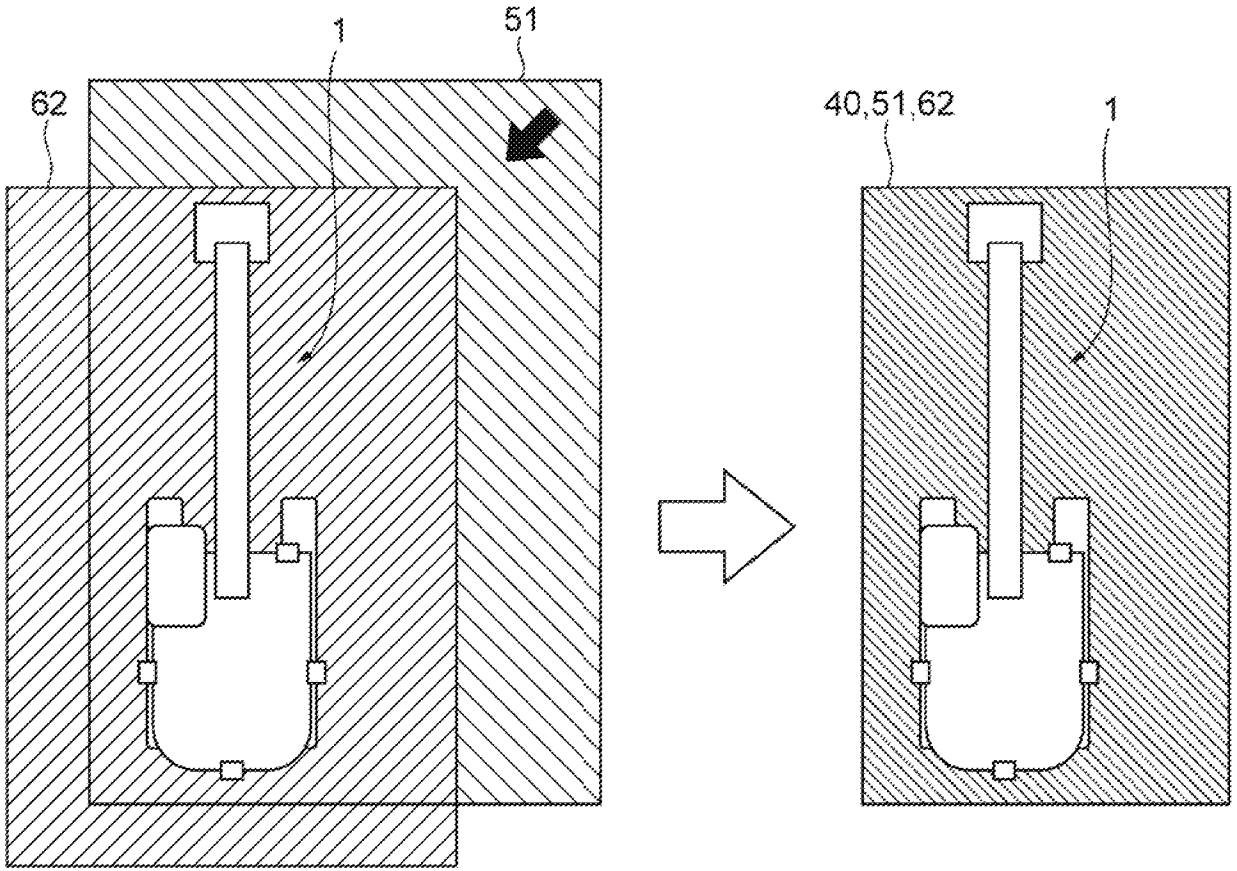
FIG. 23 is a diagram illustrating an area of the operation assistance function according to the second embodiment (second example).

FIG. 22 and FIG. 23 are diagrams illustrating the areas of the operation assistance function according to the second embodiment. In FIG. 22 and FIG. 23, an area 62 enclosed by a rectangle is a range (area) that the detection device 58 can detect, and an area 51 enclosed by a rectangle is a work area to be set. In the present embodiment, when an area outside of the detectable range 62 is set as the work area 51 as shown in the left illustration of FIG. 22, the work area 51 will be reduced to the detectable range 62 as shown in the right illustration of FIG. 22 because an object outside of the detectable range 62 cannot be detected. Meanwhile, when an area including an area outside of the detectable range 62 is set as the work area 51 as shown in the left illustration of FIG. 23, the work area 51 will be reduced to the area overlaid on the detectable range 62 as shown in the right illustration of FIG. 23 because an object outside of the detectable range 62 cannot be detected. In other words, when an area including the outside of the detectable range 62 of the detection device 58 is set as the work area 51, an area simultaneously satisfying both of the detectable range 62 and the area set as the work area 51 will be set as the work area 51. Furthermore, as already described, setting the work area 51 enables the operation assistance function, and then the stop area 40 will be set as the area equal to the work area 51 and the detectable range 62. In this case, even when the deceleration area 39 and the notification area 38 are set, areas for the deceleration area 39 and the notification area 38 will not be set because they are outside of the detectable range 62.

According to the second embodiment, as in the first embodiment, in the operation assistance system for a work machine having both operation assistance and work assistance functions, it is possible to reduce the inconvenience to an operator or the like of setting an area of the operation assistance function and an area of the work assistance function (in particular, an area of the operation assistance function), and prevent a collision of the work machine with an object in a work area.

In addition, when an area including the outside of the detectable range 62 of the detection device 58 is set as the work area 51, the operation assistance system sets as the work area 51 an area simultaneously satisfying both of the detectable range 62 and the area set as the work area 51. This allows appropriate setting of the work area 51 and the stop area 40.

It should be noted that the present invention is not limited to the aforementioned embodiments, and includes various modifications. Although the aforementioned embodiments have been described in detail to clearly illustrate the present invention, the present invention need not include all of the configurations described in the embodiments.

In addition, some or all of the aforementioned functions of the controller of the embodiments may be implemented as hardware by designing them as an integrated circuit, for example. Alternatively, the aforementioned functions of the controller of the embodiments may be implemented as software through analysis and execution of a program that implements each function by a processor. Information such as the program that implements each function, tables, and files can be stored in a storage device such as a hard disk, or a SSD (Solid State Drive); or a storage medium such as an IC card, an SD card, or a DVD, in addition to a storage device in the controller.

REFERENCE SIGNS LIST

1 Hydraulic excavator (work machine)
2 Traveling body
3 Turning body
4 Cab
5 Machine room
6 Counterweight
7 Work implement
8 Boom
9 Arm
10 Bucket
11 Boom cylinder
12 Arm cylinder
13 Bucket cylinder
14 Turning motor
15*a* Left traveling motor
15*b* Right traveling motor
16 Hydraulic pump
17 Engine (prime mover)
18 Body inclination sensor
19 Boom inclination sensor
20 Arm inclination sensor
21 Bucket inclination sensor
22 Turning angle sensor
23 First GNSS antenna
24 Second GNSS antenna
25 Detection device
25*a* Front side detection device
25*b* Right side detection device
28
25*c* Rear side detection device
25*d* Left side detection device
26 Detection range
26*a* Front side detection range
26*b* Right side detection range
26*c* Rear side detection range
26*d* Left side detection range
27 Controller
28 Buzzer (notification unit)
29 Switch
30 Attitude sensor
31 Monitor
32 Control lever
33 Flow rate control valve unit
34 Turning flow rate control valve
35 Solenoid proportional pressure reducing valve unit
36*a* Leftward turning solenoid proportional pressure reducing valve
36*b* Rightward turning solenoid proportional pressure reducing valve
37 Pilot pump
38 Notification area
39 Deceleration area
40 Stop area
41 Deceleration factor calculation unit
42 Required speed calculation unit
43 Speed limit calculation unit
44 Flow rate control valve control unit
45 Front side work area
46 Right side work area
47 Rear side work area
48 Left side work area
49 Upper side work area
50 Lower side work area
51 Work area
52 Distance calculation unit
53 Work area determination unit
54 Operation assistance enabled/disabled state determination unit
55 Operation assistance area determination unit

56 Server
57 Notification unit (installed at site)
58 Detection device (installed at site)
59 Worker
60 Dump truck
61 Communication device
62 Detectable range

The invention claimed is:

1. An operation assistance system for a work machine comprising:

an operation assistance function of stopping a work machine when an object is detected in a stop area set in advance based on detection information from a detection device that detects an object around the work machine with a work implement; and a work assistance function of preventing the work machine from going out of a work area set in advance based on attitude information of the work machine, wherein both of the operation assistance function and the work assistance function are switchable between enabled and disabled states, when the work assistance function is in an enabled state and when the work area is set outside of the stop area to surround the stop area, the operation assistance system sets the work area as the stop area such that the stop area is extended and overlaid on the work area, and automatically enables the operation assistance function when the operation assistance function is in a disabled state, the work machine is one of a wheel loader, a crane, a bulldozer, a dump, or a road machine, and the one of a wheel loader, a crane, a bulldozer, a dump, or a road machine is controlled in accordance with at least the operation assistance function and the work assistance function.

2. The operation assistance system for a work machine according to claim 1, wherein when the work area is set as the stop area such that the stop area is extended and overlaid on the work area, and when a deceleration area is set outside of the set stop area and an object is detected in the deceleration area based on detection information from the detection device, the operation assistance system decelerates the work machine.

3. The operation assistance system for a work machine according to claim 1, wherein when the work area is set as the stop area such that the stop area is extended and overlaid on the work area, and when a notification area is set outside of the set stop area and an object is detected in the notification area based on detection information from the detection device, the operation assistance system makes a notification from a notification unit provided in the operation assistance system.

4. The operation assistance system for a work machine according to claim 1, wherein when an area including an outside of a detectable area of the detection device is set as the work area, the operation assistance system sets as a work area an area simultaneously satisfying both of the detectable area and the area set as the work area.

* * * * *